US006715563B2

(12) United States Patent
Hubbard

(10) Patent No.: US 6,715,563 B2
(45) **Date of Patent: *Apr. 6, 2004**

(54) METHOD AND APPARATUS FOR VIBRATORY KINETIC ENERGY GENERATION AND APPLICATIONS THEREOF

(76) Inventor: Melvin L. Hubbard, 28286 Greenwald Ave., Perris, CA (US) 92570

( * ) Notice: Subject to any disclaimer, the term of this patent is extended or adjusted under 35 U.S.C. 154(b) by 0 days.

This patent is subject to a terminal disclaimer.

(21) Appl. No.: 09/995,533

(22) Filed: Nov. 28, 2001

(65) Prior Publication Data

US 2002/0070038 A1 Jun. 13, 2002

Related U.S. Application Data

(63) Continuation-in-part of application No. 09/724,697, filed on Nov. 28, 2000.
(60) Provisional application No. 60/253,684, filed on Nov. 28, 2000.

(51) Int. Cl.[7] ..... E21B 7/02
(52) U.S. Cl. ..... 173/184; 173/1; 173/49
(58) Field of Search ..... 173/1, 49, 184, 173/100

(56) References Cited

U.S. PATENT DOCUMENTS

| | | | | |
|---|---|---|---|---|
| 2,619,748 A | | 12/1952 | McIntosh | |
| 2,702,502 A | | 2/1955 | Cutter | |
| 2,792,769 A | | 5/1957 | Harshberger | |
| 3,030,715 A | | 4/1962 | Bodine | |
| 3,508,616 A | | 4/1970 | Hubbard | |
| 3,770,322 A | * | 11/1973 | Cobb et al. | 299/37.5 |
| 3,868,145 A | | 2/1975 | Cobb et al. | |
| 3,909,149 A | | 9/1975 | Century | |
| 3,935,712 A | | 2/1976 | Erickson et al. | |
| 3,958,613 A | | 5/1976 | Herz | |
| 4,211,121 A | * | 7/1980 | Brown | 74/87 |
| 4,667,742 A | | 5/1987 | Bodine | |
| 4,815,328 A | | 3/1989 | Bodine | |
| 5,039,252 A | * | 8/1991 | Schuermann | 405/182 |
| 5,088,565 A | * | 2/1992 | Evarts | 173/49 |
| 5,437,341 A | * | 8/1995 | Horn et al. | 175/122 |
| 5,458,204 A | * | 10/1995 | Tunkers | 173/49 |
| 5,596,824 A | * | 1/1997 | Scott et al. | 37/403 |
| 5,658,091 A | | 8/1997 | Goughnour et al. | |
| 6,009,948 A | | 1/2000 | Flanders et al. | |
| 6,234,718 B1 | * | 5/2001 | Moffitt et al. | 405/182 |

* cited by examiner

*Primary Examiner*—Stephen F. Gerrity
*Assistant Examiner*—Thanh Truong
(74) *Attorney, Agent, or Firm*—Mark D. Wieczorek

(57) ABSTRACT

A device and method for performing a task employing vibration of a tool. The device includes a housing containing at least one off-center weight, and the off-center weight is coupled to a motor and configured to rotate or revolve to vibrate the housing. The housing further includes a device mount to allow the housing to be removably coupled to a mount on a vehicle. A tool is removably coupled to the housing via a socket on the housing to perform a task. The housing may be coupled to a plurality of types of vehicles and is such that a plurality of types of tools may be coupled to the housing.

13 Claims, 25 Drawing Sheets

METHOD AND APPARATUS FOR VIBRATORY KINETIC ENERGY GENERATION AND APPLICATIONS THEREOF

CROSS-REFERENCE TO RELATED APPLICATIONS

This application is a conversion of and claims priority to co-pending U.S. Provisional Patent Application Serial No. 60/253,684, filed on Nov. 28, 2000, entitled "Method and Apparatus for Vibratory Kinetic Energy Generation and Applications Thereof", and is a continuation-in-part of co-pending U.S. patent application Ser. No. 09/724,697, filed on Nov. 28, 2000, entitled "Method and Apparatus for Vibratory Kinetic Energy Generation and Applications Thereof", the entirety of each is incorporated herein.

FIELD OF THE INVENTION

The present invention relates to vibratory motion machines, and more particularly to vibratory motion machines having modular components.

BACKGROUND OF THE INVENTION

The construction industry in the United States includes highway construction and maintenance, building construction and maintenance, mining, dams, machinery rental agencies, etc., that contribute to the national infrastructure. Analogues may be seen around the world. These areas are expanding and must be continually upgraded and maintained.

For example, the U.S. Transportation Equity Act, which became law on Jun. 9, 1998 calls for $217,000,000,000 to be spent over six years to upgrade the national infrastructure. $5,000,000,000 is estimated to be the cost to rebuild the war-ravaged country of Kosovo. Both of these massive efforts will require high quality, efficient, and modular construction equipment to be employed.

Present heavy machine equipment is generally not modular. For example, a different prime mover and set of tools may be placed on a typical tractor but the prime mover and set of tools within the set do not vary a great deal. For example, the prime mover may be of different sizes or some tools of a different shape. However, they typically cannot be said to accommodate a truly wide range of tools. In other words, most devices currently attached to, e.g., tractors, are dedicated tools. Moreover, the tools so provided may or may not be efficiently driven by the prime mover.

Sonic devices have been employed in certain instances. However, these have limitations such as material fatigue due to high frequency molecular vibrations, as well as limited frequencies of operation.

SUMMARY OF THE INVENTION

The present invention overcomes the disadvantages of the prior art noted above.

In one aspect, the invention is related to a device for performing a task employing vibration of a tool. The device includes a housing containing at least one off-center weight, and the off-center weight is coupled to a motor and configured to rotate or revolve to vibrate the housing. The housing further includes a device mount to allow the housing to be removably coupled to a mount on a vehicle. A tool is removably coupled to the housing via a socket on the housing to perform a task. The housing may be coupled to a plurality of types of vehicles and is such that a plurality of types of tools may be coupled to the housing.

Implementations of the invention may include one or more of the following. The tool may be selected from the group consisting of: bores, augers, cable layers, trenchers, blades, shakers, rollers, planars, grinders, tillers, rakes, tampers, grid layers, scarifiers, conveyors, winches, scrapers, mixers, shaker screens, corers, destruction tools, drills, cutters, double line cutters, pipe cleaners, and combinations thereof. In another aspect, the invention is directed towards a method of performing a task employing vibration of a tool. The method includes providing a housing containing at least one off-center weight, the off-center weight coupled to a motor and configured to rotate or revolve to vibrate the housing; removably mounting the housing via a device mount to a mount on a vehicle; removably mounting a tool to the housing via a socket on the housing, to perform a task; and rotating or revolving the off-center weight.

The present invention has numerous advantages over prior systems. The present invention employs an adjustable amplitude that can be much greater than that achieved with sonic, e.g., ultrasonic, devices. The force achieved is employable in a variety of applications. The present invention achieves less tool fatigue than that that would be endured in sonic devices. The present invention may be employed at numerous frequencies, unlike sonic devices. In fact, the only limitation on the frequency is the desire of the user, as well as the material limitations of the particular tool. For example, rock may break at numerous frequencies, while asphalt only one. Further, compaction of soil varies with the soil and depth; however, if too much energy is applied, the soil may "resound" and defeat compaction. The present invention allows such factors to be overcome.

The work of the device is accomplished primarily by the oscillation of the vibratory device. For example, in an asphalt-cutting tool, a blade may move forward into asphalt due to an amplitude of motion of the vibratory device. The amplitude and direction may then reverse, traveling "backward" during which time the tractor or other vehicle moves forward, moves forward, advancing the blade into a new and "fresh" cutting position. The process may, in one scenario, be repeated 2000 times per minute. Due to inertia, the process may appear to be continuous.

Advantages of the invention may include one or more of the following. The invention may be modular and may allow use of a number of different tools. The invention generates a large amount of vibratory energy to assist the tool in performing the desired function. The invention may be made sufficiently small to allow use in a wide variety of work environments. The invention may allow a tool to operate with enhanced force, speed, or a combination of the two. The invention may be easily adapted to retrofit on almost any current tractor or crane or taxtavator, etc. The invention may employ a relatively low horsepower motor but still be self-propelling in the sense that the device may be moved by a contained engine and the engine may further be used to drive another device, e.g., via hydraulics. The device may employ relatively easy to repair components such as belts, in lieu of or in addition to more difficult to repair components such as gears. The device may be easy to rotate and easy to swivel horizontally or vertically via a gimbel. The above noted hydraulics may be employed to move the device on the gimbel. The device may employ a ratcheted or stepper motor to allow the device to drive drill tools, planers, trenchers, etc. Other such driven tools are described below in more detail. The amplitude of vibration of the device may be easily changed by changing the drive pulley. Similarly, the belt pulley ratio may be easily so changed. The invention need not employ sonic vibrations, which is preferable as the amplitude of vibration can be made much greater with variable force and is more applicable to more applications. Sonic forces have been associated with fatigue of vibrating materials due to the high frequency. With non-sonic vibrations, tuning is achievable which can be adjusted to the work done. For example, rock breaks at different frequencies than asphalt. A device according to an embodiment of the invention may thus be tuned for different tasks.

Other advantages will be apparent from the description that follows, including the figures and the claims.

BRIEF DESCRIPTION OF THE DRAWINGS

General Construction of the Vibratory Device

DETAILED DESCRIPTION OF THE PREFERRED EMBODIMENTS

Figure 1:
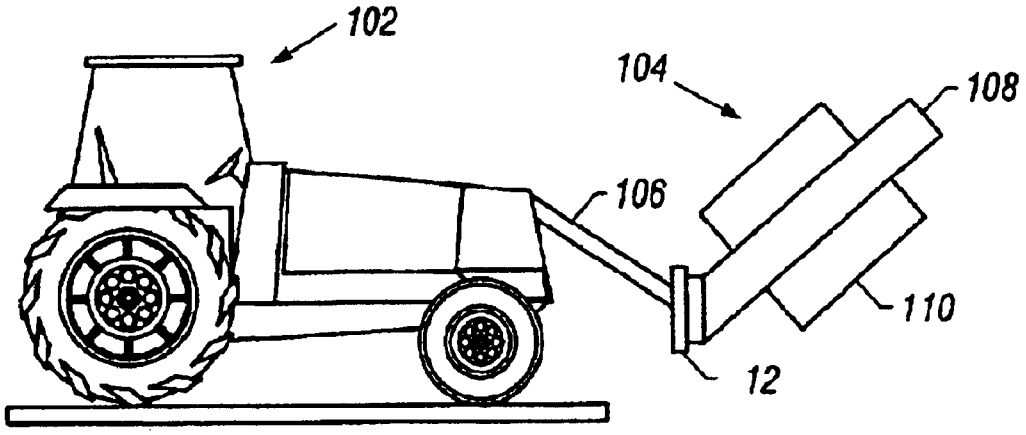
FIG. 1 is a schematic side view of a tractor and device according to an embodiment of the present invention.
Figure 2:
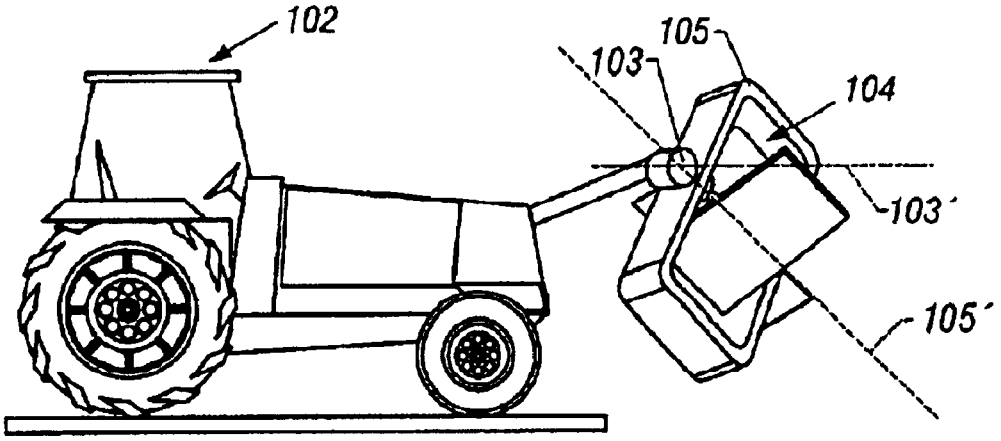
FIG. 2 is a partial perspective view of a tractor and device according to an embodiment of the present invention.
Figure 3:
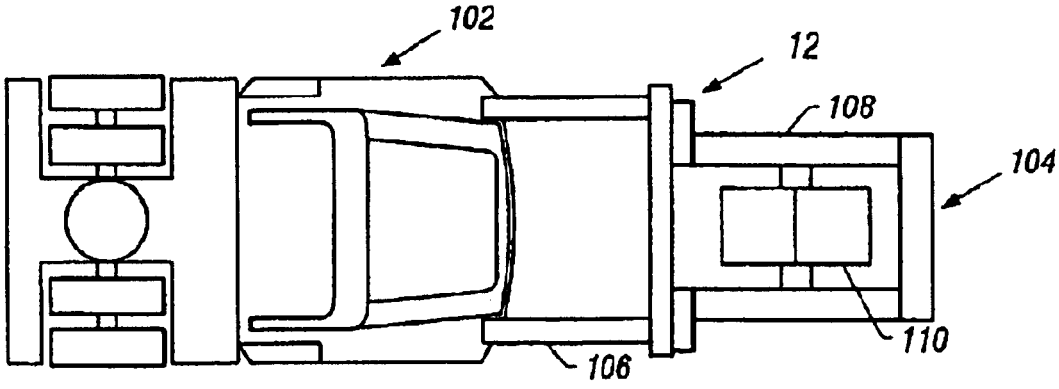
FIG. 3 is a schematic top view of the tractor and device according to the embodiment of FIG. 1.

FIGS. 1, 2 and 3 show schematic side and top views of a tractor and device according to an embodiment of the present invention. In particular, a tractor 102 is shown connected to a vibratory device 104 via a boom 106. The boom 106 is connected to the vibratory device 104 via a mount 12. The vibratory device 104 includes a support structure 108 and a vibratory box 110. These aspects, as well as other aspects, are now discussed in more detail.

Figure 4:
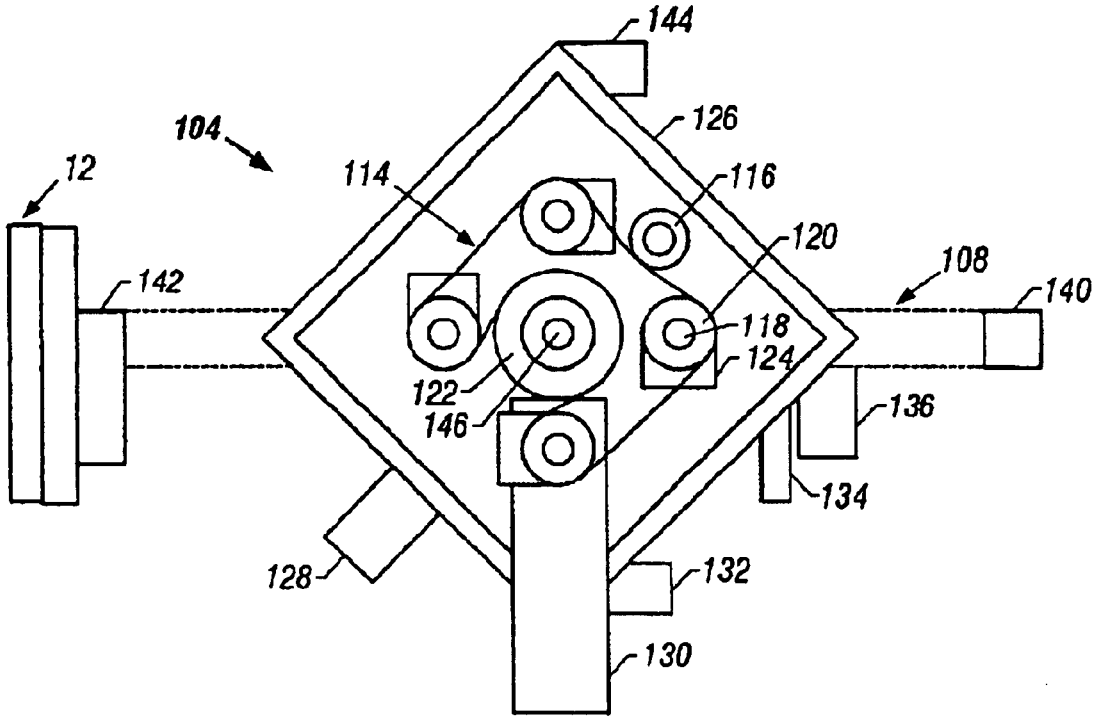
FIG. 4 is a schematic side view of a vibratory device according to an embodiment of the present invention.
Figure 5:
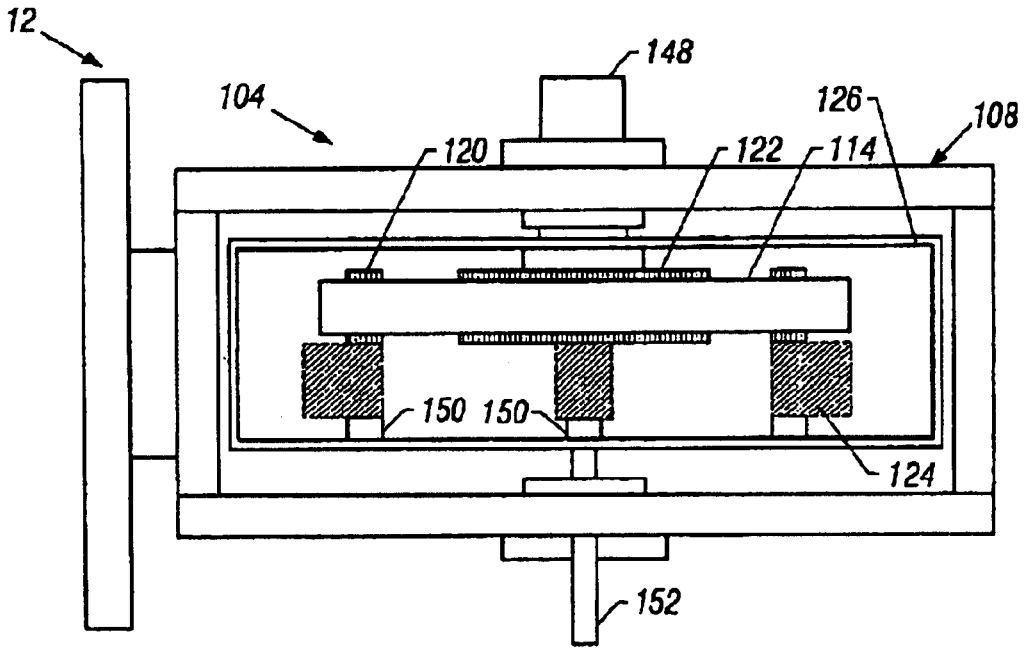
FIG. 5 is a schematic top view of a vibratory device according to an embodiment of the present invention.
Figure 9:
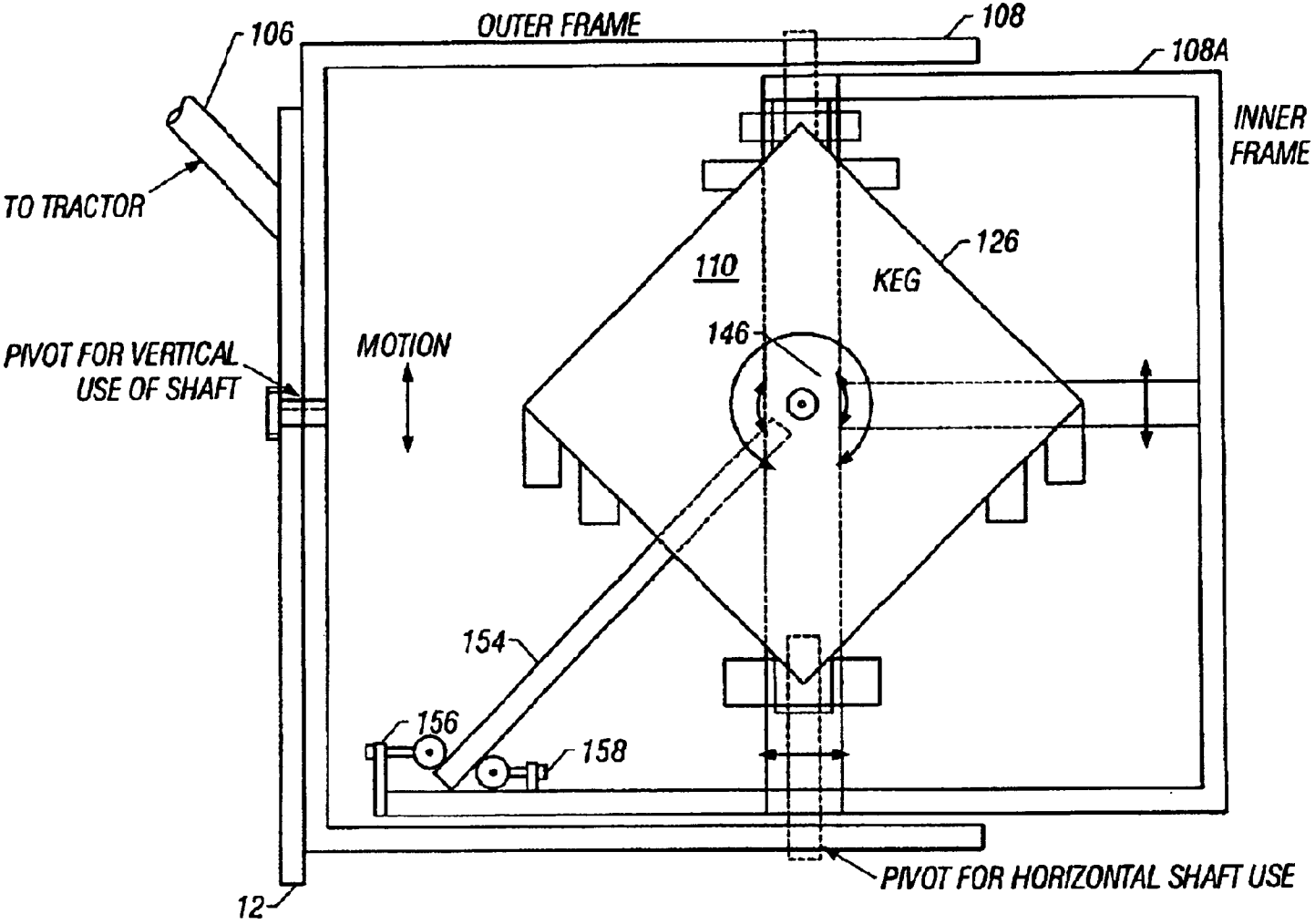
FIG. 9 is another view of the embodiment of FIG. 5.

Referring to FIGS. 4 and 5, in which side and top views, respectively, of the vibratory device 104 are shown schematically, the mount 12 is shown connected to the vibratory box 110 via support structures 103 and 105 (see FIG. 2), each of which is a housing that allows independent movement of the vibratory device 104 about axes 103' and 105', respectively. In particular, support structure 105 provides an inner frame and support structure 103 provides an outer frame. Other mounts may also be used as are known in the art. FIG. 9 provides an additional view of the embodiment of FIG. 5.

The location of the tool mounting may affect the operation of the tool and the decision on which tool to use. For example, if using a vibrating roller, discussed below, the far front end of the device may be used, allowing vertical movement up and down and allowing the tractor's hydraulic boom to put downward pressure on the roller as well. Conversely, if an asphalt cutter blade is used, the best position may be to mount the same on the bottom of the vibratory device (see, e.g., FIG. AC-1 below).

The vibratory box 110, that may be used in many different positions, includes a housing 126 in which are included a number of hubs 120, rotating on a corresponding number of axles 118, to which are attached a corresponding number of off-center weights 124. The housing 126 may be constructed of stock materials. While shown to be roughly square, the same may be rectangular, round, etc.

The off-center weights revolve about the axles 118 at a common angular speed due to a common belt 114, such as a common double-cog belt 114. FIG. 4 also shows a tensioner or idler 116 that may be employed to adjust the tension on the belt 114. The tensioner function is an advantage of the belt system: if the belt is worn and becomes loose, the idler or tensioner may be employed to take up any undesired slack in the belt or allow for different gear ratios and adjust the belt accordingly.

The weights may be timed in balance relative to vibrations exterior of the vibratory device. They may be swiveled, e.g., via a ball socket, to relieve the bearing load from precession as well as from other loads. The weights and the belt generally rotate only inside the housing for safety. The weights may be rotated in either direction.

Figure 10:
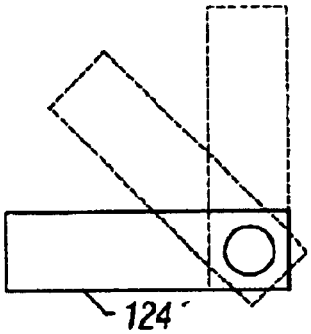
FIG. 10 shows a view of a first embodiment of a device providing weight control that may be employed according to the present invention.

In more detail, and referring to FIGS. 10–13, a variety of weight control techniques may be employed. In FIG. 10, a simple swivel weight 124' is shown. The weight can be changed by, e.g., choice of materials. The weight lags upon start-up as can be seen in FIG. 10, where the post-start-up situation is shown in dotted lines. The lag of the weight can be increased with spring tension such as via a coil spring wrapped around the shaft and connected to the weight or by a leaf spring system.

Figure 11:
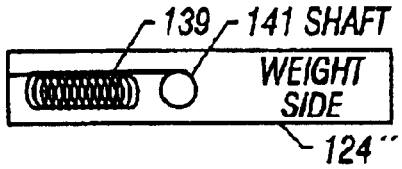
FIG. 11 shows a view of a second embodiment of a device providing weight control that may be employed according to the present invention.

In FIG. 11, a weight 124" is shown which is spring-loaded. Depending upon the strength of spring 139, the weight 124" may remain equal on both sides of shaft 141 until the acceleration due to rotation becomes such that the weight 124" overcomes the spring and thus moves outward. This embodiment has the helpful feature of decreasing the amount of power required at start-up. In a related embodiment, a coil spring may be employed to provide a starting weight position of, e.g., 20 degrees ahead of the planned rotation of the shaft. In this way, upon rotation, the acceleration moves the weight to a radial position with respect to the rotation of the main shaft, thereby lowering the power required at start-up. The weight pivot assembly can be, e.g., a ball and socket or the like.

Figure 12:
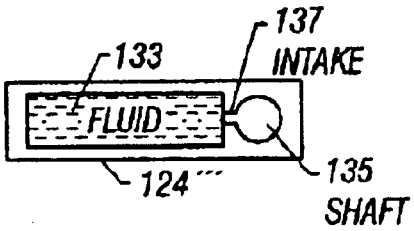
FIG. 12 shows a view of a third embodiment of a device providing weight control that may be employed according to the present invention.

In FIG. 12, a weight 124'" is shown in which a heavy media fluid 133 can be pumped into and out of (via intake 137) a rotating canister or shaft 135 to alter the weight. The acceleration gained in rotation can aid in the process. The fluid can use a tubular shaft for intake and exhaust thru weight via a controlled open and closed pipe, such as by a valve.

Figure 13:
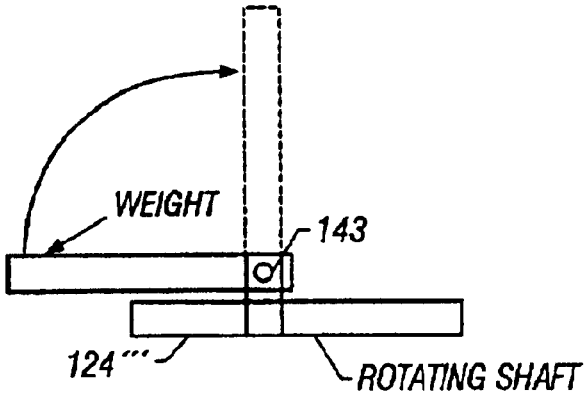
FIG. 13 shows a view of a fourth embodiment of a device providing weight control that may be employed according to the present invention.
Figure 14:
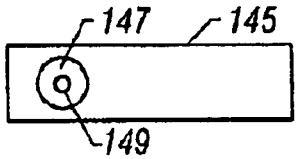
FIGS. 14 and 15 show views of a first embodiment of a device providing precession relief that may be employed according to the present invention.
Figure 15:
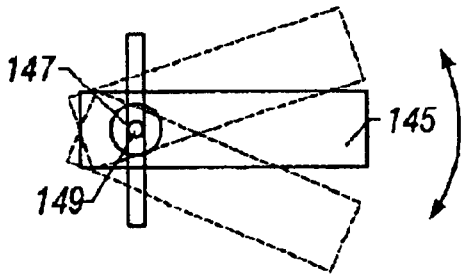

In FIG. 13, a weight 124"" pivots about point 143. Friction or a spring located at the weight's pivot point will affect the precession via acceleration that rotates weight outward, again decreasing the amount of power required at start-up. If the weight is rotating and the shaft precesses, the weight will pivot, reducing the precession and the bearing load on the frame.

Figure 16:
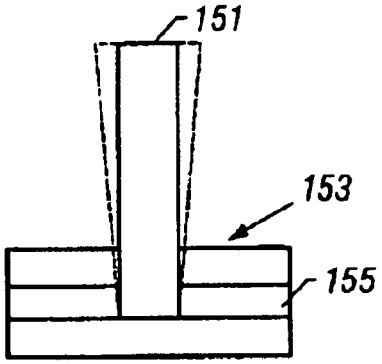
FIGS. 16 and 17 show views of a second embodiment of a device providing precession relief that may be employed according to the present invention.
Figure 17:
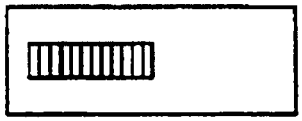

FIGS. 14–17 show various other methods of affording precession relief. In particular, referring to FIGS. 14 and 15, a weight 145 pivots about a shaft 149 via a ball socket 147. In this embodiment, the weight is allowed to move, within limits, without putting excess strain on the shaft's bearing if precession should occur. In FIGS. 16 and 17, a weight 151 is mounted to shaft 155 which is in turn mounted in a slotted channel. In this system, the shaft and the weight may both move during precession. The shaft is, however, restricted from moving in any but the desired directions. Springs may be employed within the channel's slot to restrict movement until a specific acceleration is reached, or until precessional forces appear.

The belt 114, which may be of a common timing belt design, e.g., a common double-cogged timing belt, may be replaced with a gear system in known fashion if desired. However, the use of the belt 114 may afford a number of advantages. If the belt requires replacement, the same may be changed by simply removing a cover of the housing, sliding the belt off, and replacing the belt. The idler may then be adjusted to conform to the new belt. The use of a timing belt lessens the requirement of strict and exact positioning of the off-center weights, as would otherwise be required in a geared system. The use of a belt also lessens the requirement of lubrication as compared with geared systems. The use of a belt reduces the overall weight of the system, and is generally less expensive than a geared system, especially with respect to changing belt ratios and/or weights. The belt may also be tightened, e.g., via a cam shaft or other such belt tightener.

The off-center weights 124 are revolvably coupled to the vibratory box 110 via a number of journals 150 (FIG. 5). During assembly, a central bulkhead holds the journals, as well as the drive shaft. At the end of the assembly, when a housing cover is being installed, the cover allows for the final alignment of the shafts, journals, and bearings.

The common belt 114 is driven by a drive shaft 146 connected to an appropriately sized hub 122. The drive shaft 146 is powered by a motor 148 (shown in FIG. 5). The motor 148 may be of a number of types, and is described in more detail below. The drive shaft 146 extends to distal portion 152, on which may be mounted a number of tools as described below.

A number of mounts are shown, such as a mount 130, a mount 132, and a mount 144. These may be employed to mount various tools to the vibratory box 110 as is described below. The mounts may employ sockets for mounting tools, such as sockets operated by hydraulic pressure on a cone or ball or the like. The socket mounts may be disposed in various locations for different types of work, tools, amplitudes, or combinations of the above.

It will be clear that numerous variations of this design may be employed to similar effect. For example, one or more off-center weights 124 may be employed. There may be an advantage to having four off-center weights since the same may be approximately evenly distributed over the volume of the vibratory box 110. However, the number and magnitude of weights could be varied in numerous ways. The more equal weights and shafts, the less the bearing load. The assembly may be operated dry or in, e.g., an oil bath.

Figure 6:
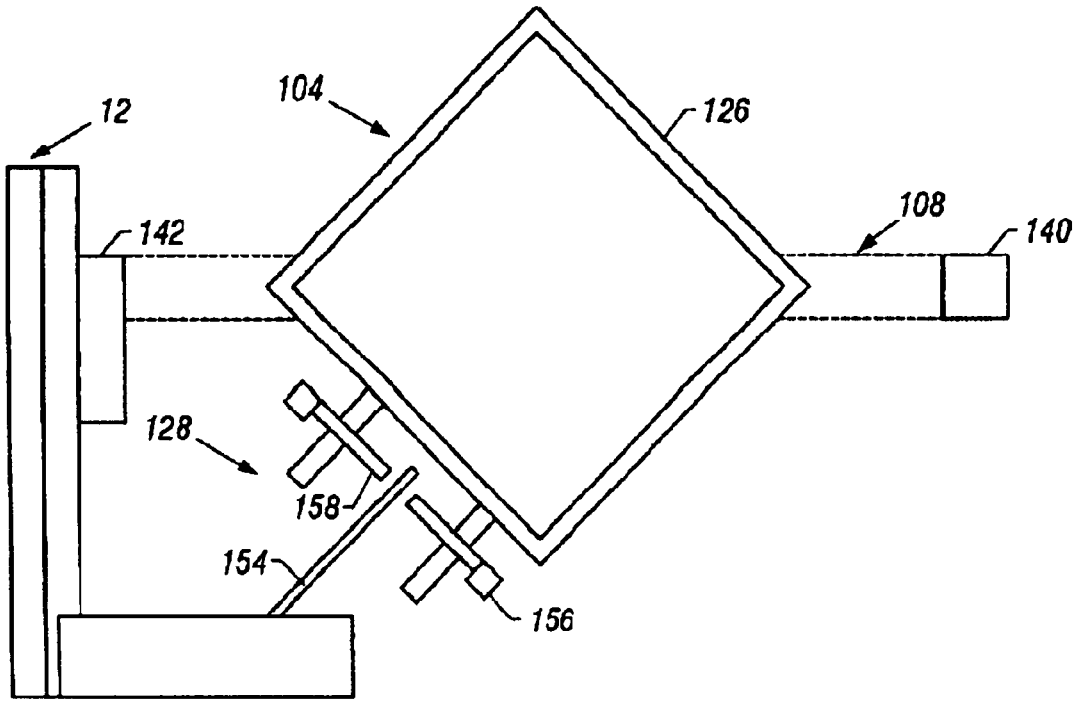
FIG. 6 shows a detail of a leaf spring system according to an embodiment of the present invention.
Figure 7:
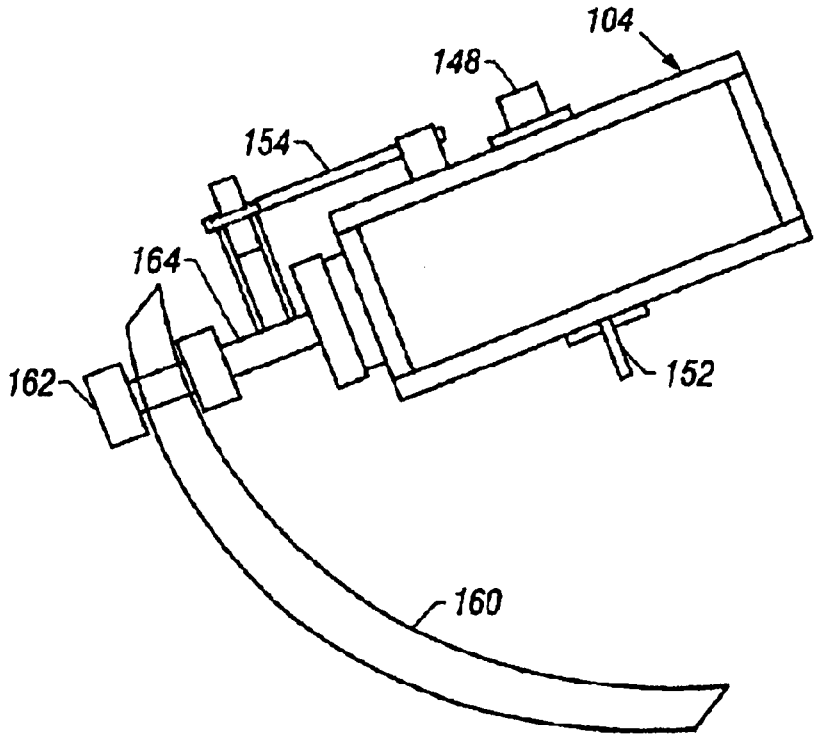
FIG. 7 shows a detail of an arc frame system according to an embodiment of the present invention.

Referring to FIGS. 6 and 7, a leaf spring system 128 is shown. The leaf spring system 128 may be advantageously employed in an embodiment of the invention. The system 128 includes a leaf spring 154 inserted between two points 158 that are movably mounted via a screw adjustment 156. While the leaf spring system 128 is shown in one location with respect to mount 12, the same may be placed at several different locations on the mount. In particular, the leaf spring system may mount to a swiveling portion to allow the leaf spring system to be used in a variety of vibratory device orientations. Of course, the leaf spring system may be disengaged when it is desired to rotate the vibratory device as described in more detail below. Rotation may further be assisted using the ratchet device described in this specification. It may be preferable in many embodiments to mount the leaf spring system to the inner support structure 105.

When the spring is removed, with or without use of the ratchet, the vibratory device may be rotated in either direction to perform various procedures during rotation, e.g., by the addition of tiller blades. Other tools could also be used. Of course, in these embodiments, sufficient clearance for tool rotation must be provided.

The leaf spring system 128 constrains the amplitude of vibration of the vibratory box 110 by a known, and changeable, amount. The leaf spring 154 flexes with the motion of the vibratory box 110, but does not allow the vibratory box 110 to rotate past a set point. By changing the clearance between the points 158 and the leaf spring 154, the amplitude of vibration of the vibratory box 110 may be changed. In an embodiment of the invention in which it is desired to have the vibratory box 110 rotate at a preset angular speed, the leaf spring system 128 may be removed. In other words, by removing the leaf spring 154, the vibratory box 110 can rotated to do work. This facility is discussed below in connection with FIG. 8.

Referring to FIG. 7, embodiment of an arc frame system is shown. The arc frame system allows the vibratory device 104 to be swiveled in either a vertical or a horizontal plane within the support structure 108. In this embodiment, in which is shown primarily a variation on mount 12, an arc frame 160 is shown to which the vibratory box 110 may be mounted. The vibratory box 110 mounts to the arc frame 160 via at least one anchor 162. The anchor 162 may simply be tightened against the arc frame 160 to secure the vibratory box 110 in a desired angular position. Of course, it should be noted that the angle subtended by the art frame 160 may be much greater, somewhat greater, or less than that shown in FIG. 7. The arc frame system may be situated either vertically, to effect vertical swiveling, or horizontally, to effect horizontal swiveling, depending on the desired position of the vibratory box 110. Two arcs may be employed to allow both motions. Typically, one arc may be employed which is capable of switching between vertical and horizontal movement.

In an application of the arc system, the vibratory device may be mounted within the arc frame system such that the vibratory device remains in a predetermined orientation even if the tractor is moving on a slope. As a corollary, a maintaining plumb may be employed to aid in determining vertical work positions.

Figure 8:
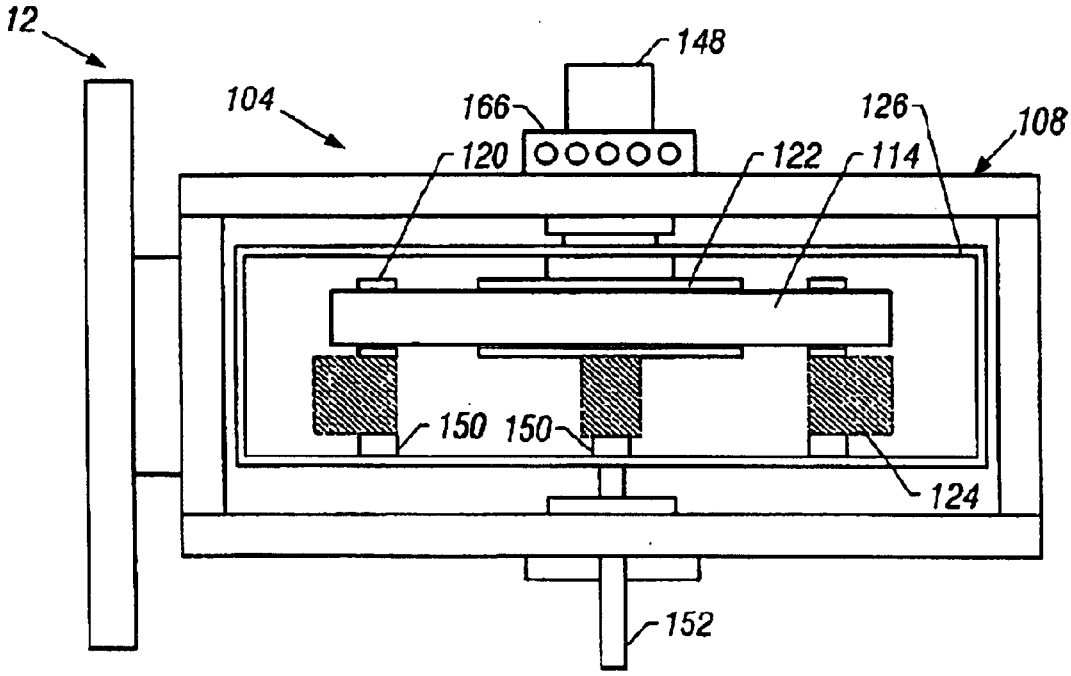
FIG. 8 shows a detail of a ratchet system used according to an embodiment of the present invention.

Referring to FIG. 8, an embodiment of a ratchet gear system used with the invention is shown. In particular, a ratchet gear 166 is shown between a motor 148' and the vibratory box 110. In this embodiment, the leaf spring 154 may or may not be removed. In such a method, the vibration of the vibratory box 110 causes the same to rotate in a back and forth manner. However, the ratchet constrains the box to only acquire a net rotation in one or the other angular direction. In other words, the ratchet is resistant to angular movement in the other direction. It should be noted that in a related embodiment a belt may be run from an axle of the ratchet to yet another shaft. In either case, the driven shaft, if appropriately housed, may rotate in a manner such as may be appropriate to drive a drill or other piece of rotating equipment or to drive the vibratory device itself via, e.g., a belt chain or the like, to make the same self-propelled.

The ratchet 166 may also be mounted independently of the shaft that drives the weights, and can further use its own shaft to establish an oscillation. The ratchet 166 may be used in either direction for positive rotations. By using two ratchets, the same may be clutched in and out for reverse positive rotations of the shaft. This may be accomplished by employing dual ratchets, each with external splines, and each engaging internal splines in a pulley when engaged. Once ratchet may be clutched so as to engage the pulley when the shaft is rotated clockwise, and the other ratchet may be clutched so as to engage the pulley when the shaft is rotated counter-clockwise (and this first ratchet being thus displaced).

Further, a pulley and appropriate mechanisms may be employed to allow the vibratory device 110 to be thus self-propelled. Even further, the ratchet may be, instead of being connected to the drive shaft, may be connected to the axle of the wheels, or to a shaft driven by either the axle or the drive shaft.

As above, then, the device may be made self-propelled. Indeed, a mere frame may be attached, sufficient to support the vibratory box, an attachment, and a motor, and the entirety may form a device according to an embodiment of the invention. The motor may alternatively be provided from an ATV-type source or other small source.

The motor 148 is now described in more detail. The motor 148 may be of relatively small horsepower, such as 15 hp, but may still allow the vibratory device to be self-propelling. The motor 148 may be powered using the tractor's normal hydraulic pump system through the hydraulic lines' so-called "quick couplings". The motor 148 may be detachably mounted, such that several different types of motors may be coupled to the vibratory box 110. As noted above, stepper motors or ratchet motors may also be employed.

Figure 19:
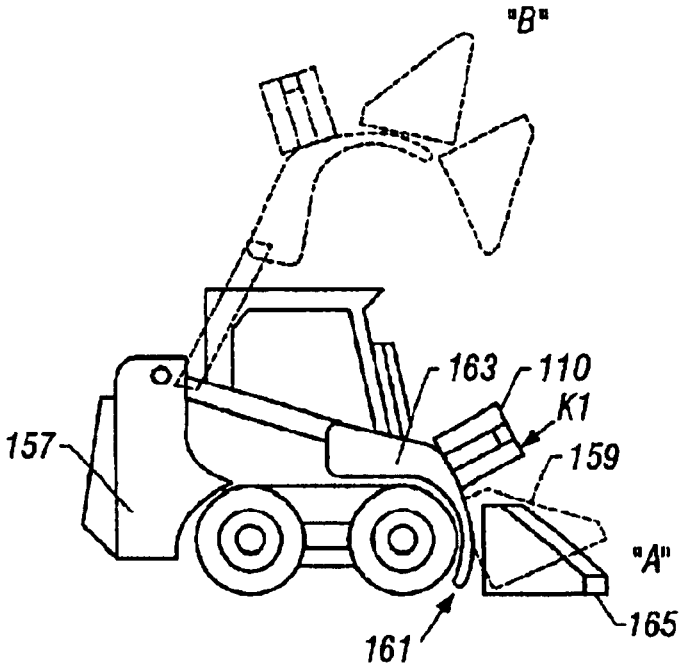
FIG. 19 shows how a vibratory device according to an embodiment of the present invention may be employed without hindering the usual functionality of a tractor.

Referring now to FIG. 19, a vibratory box 110 may be seen to be employed with standard equipment, such as tractor 157. In particular, vibratory box 110 is mounted on the boom 163 of tractor 157 at, e.g., connection point 159. The connection may be made by a solid bar connection between the vibratory box and the loader 165. As can be seen, the loader 165 may move from point "A" to point "B" without hindrance.

However, the vibratory box 110, if operated during loading operations, may well contribute to cutting, loading, and unloading of materials, especially materials that may tend to otherwise stick to the loader bucket, such as tar, mud, tarred asphalt, etc. The vibratory box 110 may be mounted on the bucket so as to allow the bucket to rotate about its pivot point, e.g., about point 161, allowing the cutting portion of the bucket to, e.g., move in a slight arc while transferring kinetic energy to the same. Of course, it will be clear to one of ordinary skill in the art, given this teaching, that such a technique may be applied to other tools as well.

Applications

Application of vibratory motion greatly facilitates the performance of the tool attached to the vibratory device. In particular, in cutting applications, earth may be cut in thicker layers than previously. Alternatively earth that might not otherwise be capable of cutting may be cut. In such or similar applications, earth is caused to undergo numerous cycles of compression and tension. The applied kinetic energy causes the earth to acquire high mobility, easing entry of the cutting blade into the same. Of course, the above explanation is for descriptive purposes only and should not be construed as limiting the invention. Other explanations are provided below with regard to particular tools. These should similarly not be construed as limiting of the scope of the invention.

Asphalt Cutting

An embodiment of the present invention may be advantageously employed to perform asphalt cutting. In this system, the motor used may be a 60 hp motor operating at 2,000 rpm. Such a system may be capable of generating oscillations of about 650 foot-lbs of force on each stroke.

A typical blade used in an asphalt cutter may be about ⅝ inch thick, 8 inches wide, and 12 inches long. The blade may be of the self-sharpening type.

Figure 20:
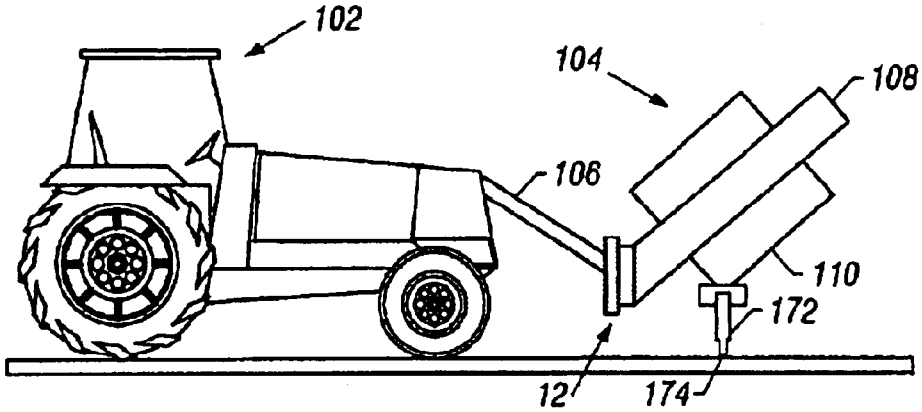
FIG. 20 shows an embodiment of the present invention in which the same is implemented with an asphalt cutter.

An example of an asphalt cutter according to an embodiment of the invention is shown in FIG. 20. In FIG. 20, the tractor 102 is shown attached to the vibratory device 104, which is in turn attached to an asphalt cutter 172 having a blade 174.

Figure 21:
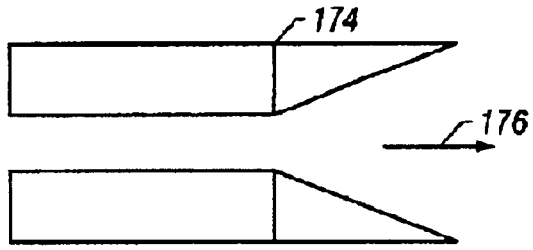
FIG. 21 shows a dual blade system which may be employed in the asphalt cutter of FIG. 18.

FIG. 21 shows a set of blades 174 for use with the asphalt cutter. The blades 174 may be angled as shown so that cut asphalt falls inward (between the blades) as the blades move in the direction of travel, here indicated as direction 176. This arrangement also helps to make the blades self-sharpening. The blades may be sharpened on either side and may cut in either direction. As the blade wears in width, but still staying sharp, the same may be transferred to the opposite side (if two blades are being used to make two cuts simultaneously). The asphalt cutter blade may be, e.g., a cutting disc instead of a solid blade. A disc, with a shaft and bearing in the center, tends to strike the asphalt below the disc fulcrum, rotating the disc. This allows cooling of the blade and distributes wear around the blade, providing a longer life and sharpness.

Other Analogous Operations

Figure 18:
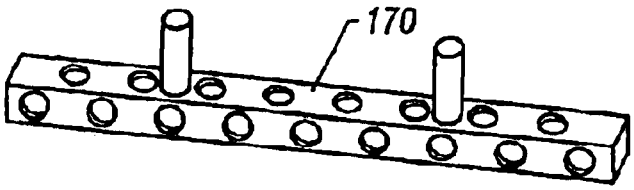
FIG. 18 shows an extension tool which may be implemented with an embodiment of the present invention.
Figure 22:
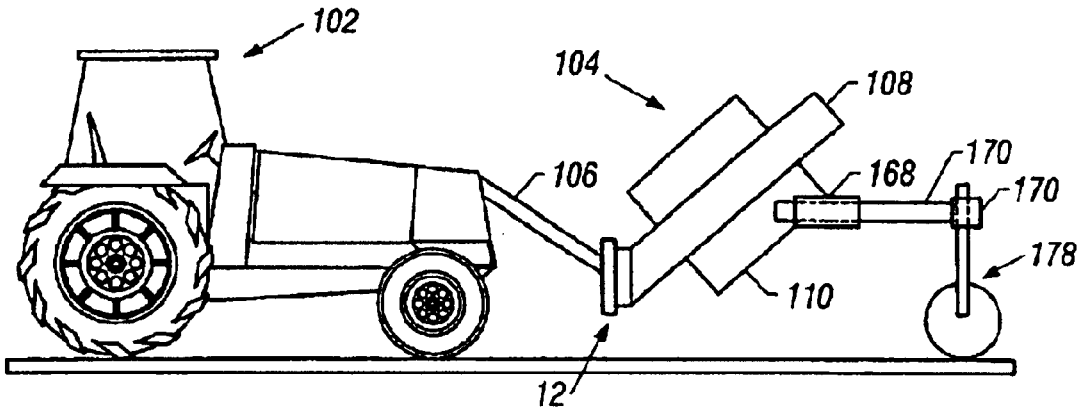
FIG. 22 shows an embodiment of the present invention in which the same is used as a vibrating roller.
Figure 23:
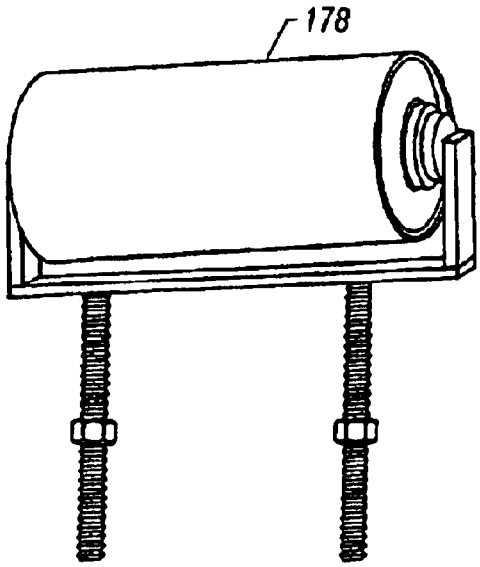
FIG. 23 shows a roller which may be implemented with an embodiment of the present invention.

By switching the tool that is attached to the extension tool 170 (seen in FIG. 18, for example), a variety of other mechanical operations can be performed. For example, by switching with a roller 178, a vibrating roller may be formed (FIGS. 22 and 23). The extension tool 170 connects the vibratory box 110 with the tool. The extension tool 170 connects to the vibratory box 110 via a connector 168. The connector 168 may be a simple fitting in which the extension tool 170 may be placed. In this case, it is preferable that the connector 168 have means within to tighten the extension tool 170 against movement in the direction of the longitudinal axis of the extension tool 170.

Referring back to the vibratory roller, the same may mount on bearings and a shaft and may have varying widths and arm lengths. Also, in lieu of an "arm", the same may mount directly to the vibratory device. In fact, most of the tools described herein may be mounted either to the device directly or to the device via, e.g., the extension tool 170. The motion of the vibratory roller is provided by the vibratory device 104 as well as by the tractor moving back and forth over the soil or trench while creating downward pressure using the tractor's hydraulic boom.

Figure 24:
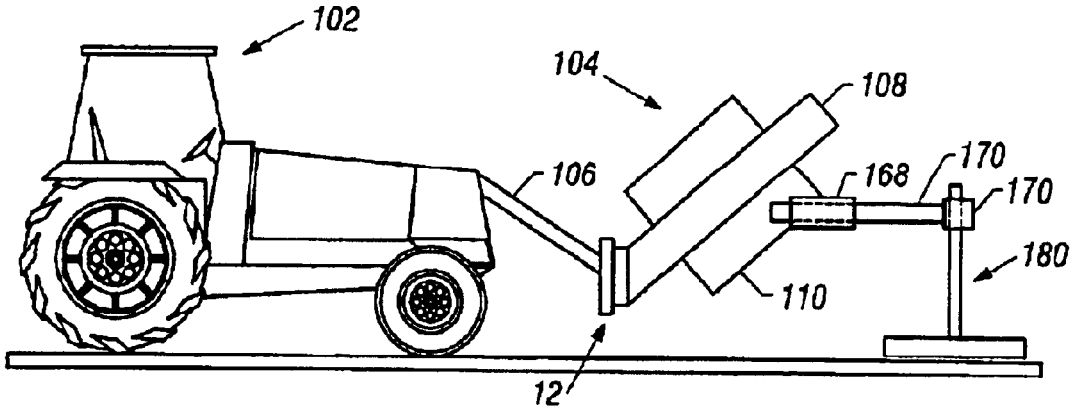
FIG. 24 shows an embodiment of the present invention in which the same is implemented with a plate tamper.
Figure 25:
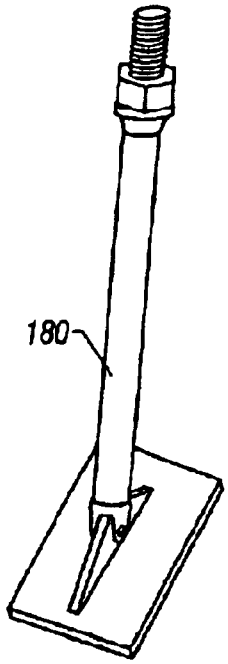
FIG. 25 shows a plate tamper which may be implemented with an embodiment of the present invention.

By switching with a plate 180, a plate tamper may be formed (FIGS. 24 and 25), or with two such plates, the amount of work performed can be doubled. To mount two plates, opposite sides of the drive shaft, e.g., those on opposite ends of a diagonal across vibratory box 110, may be used. Various length shafts may be employed, and the same may be mounted to a plate, which can also have various sizes. The plate 180 may be swiveled at the shaft end connection. The mounts may be varied to affect the length of the shaft's "strike". When tamping soil in trenches, different length shafts may be employed to allow different depth trenches to be tamped. Downward pressure may be applied via the tractor's hydraulic boom, this last feature applicable to various other tools described herein as well.

Figure 26:
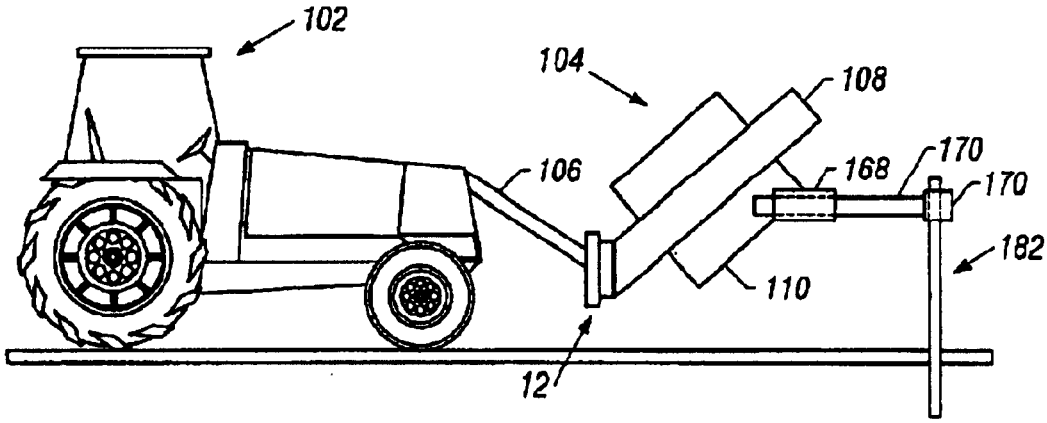
FIG. 26 shows an embodiment of the present invention in which the same is implemented with a destruction tool.
Figure 27:
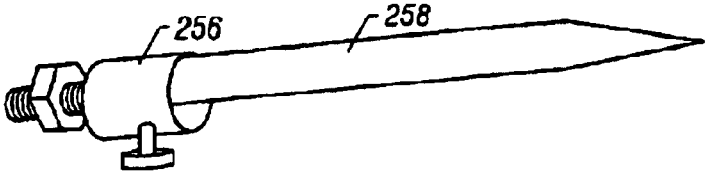
FIG. 27 shows another embodiment of a destruction tool which may be implemented with an embodiment of the present invention.

By switching with a blunt but strong blade-like tool 182, a vertical concrete breaker or destruction tool may be formed (FIGS. 26 and 27). In particular, vertical or horizontal destruction tools 182 may mount to various sockets of the vibratory device assembly, or to an extension tool 170. Different sockets may be used to allow for different amplitudes. A downward pressure may be created by the boom of the tractor. Two destruction tools may be used simultaneously (not shown). Another embodiment of a destruction tool 258 is shown in FIG. 27, where tool 258 is mounted in a holding device 256.

Figure 51:
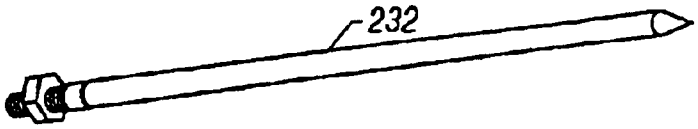
FIGS. 51 and 52 show post and pile drivers that may be implemented with an embodiment of the present invention.
Figure 52:
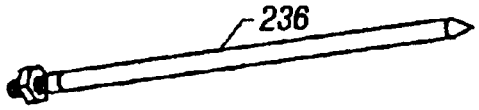

In a related embodiment, a post and pile driver is shown in FIGS. 51 and 52. The operation of this may be similar to that of the destruction tools. The post and pile driver may be a pole 232 or 236 that is mounted to the vibratory device 104 on the main shaft for vibration along with a downward pressure force from the boom of the tractor. In this embodiment, as well as in all other embodiments described herein or evident from this description, the driver may be mounted on either side of the device, or in other locations on the device, for variations of stroke or vibration amplitude and force.

In another embodiment, a variation of the holding device 256 may be used which provides a holding force on the downstroke but not on the upstroke. In this way, the holding device 256 forces the pile into the ground on the downstroke and, on the upstroke, the attachment point of the holding device to the pile is moved progressively higher with each stroke. A suitable cam mechanism can be used for such a holding device 256. While shown with respect to holding device 256, this embodiment may be even more useful with respect to pile driving.

Figure 53:
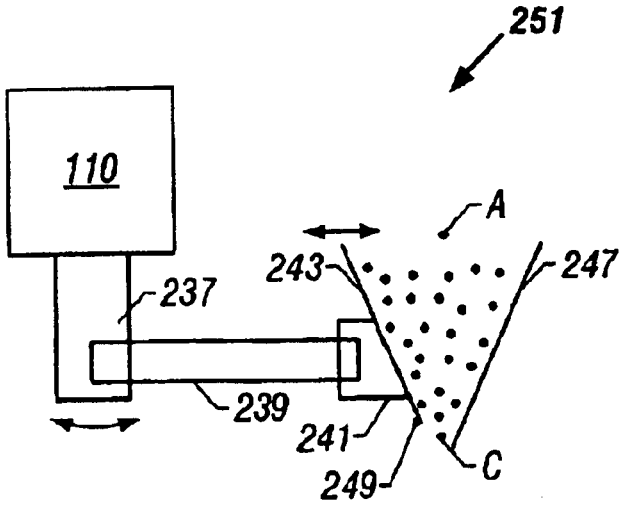
FIG. 53 shows a rock crusher according to an embodiment of the present invention.

FIG. 53 shows a rock crusher 251 according to an embodiment of the present invention. In a related embodiment, the device may be used as an extruder. In either case, a first crusher plate 243 is movable by virtue of its ability to pivot about a lower bearing 249. A second crusher plate 247 is stationary. Rocks or other material may enter the throat of the crusher by gravity or by being force-fed at a point "A" between the plates. The plate 243 is connected to the lower portion of the oscillation of the vibratory box 110 by a connector 239 that has bearing pivots at both ends and which mounts near the top of the first crusher plate. When the vibratory box operates, it forces the first crusher plate toward the second. As rocks or other material enter at point "A", they wedge between the plates as the first plate moves away from the second. When the first plate moves back towards its maximum oscillation towards the second plate, it crushes the rocks or other material into smaller portions. These smaller portions then progress out of the crusher at point "C", providing the angles of plates 243 and 247 are appropriate. The opening of the area of discharge of the smaller portions at "C" is one of the factors that determines the crushing ratio, i.e., the number of times that larger rocks are crushed or broken, prior to progressing out of the crusher. These factors also control "production" and "crushing tonnage". In a tractor embodiment, the stationary plate may be mounted to a tractor.

In the extruder version, dies can be placed at point "C" to shape and control the size of the material being extruded. This can be applied to, e.g., hot steel as well as to clay-like materials such as bricks prior to firing. Other materials which may be employed include concrete, asphalts, such as for curbs, and other like materials, including brickettes.

Figure 54:
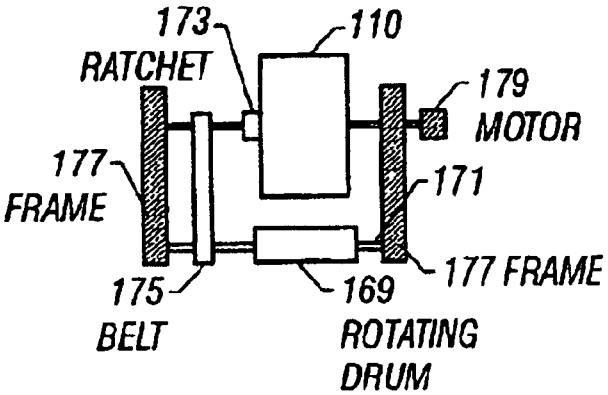
FIG. 54 shows a view of an asphalt and concrete planer according to an embodiment of the present invention.

FIG. 54 shows a view of an asphalt and concrete planer according to an embodiment of the present invention. In this embodiment, a rotating drum 169 is driven on a second shaft 171 via vibratory box 110 coupled to ratchet 173 and belt 175. The entire system is mounted on frame 177 and is driven by motor 179.

Figure 55:
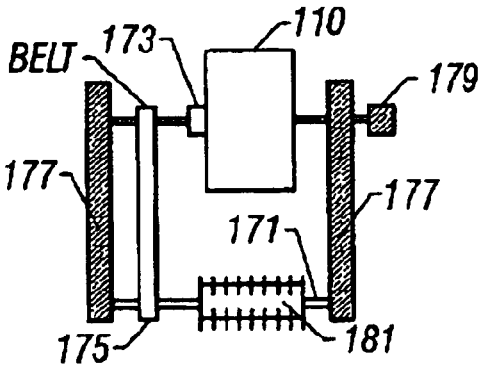
FIG. 55 shows a view of a ground tiller according to an embodiment of the present invention.

In a related embodiment, FIG. 55 shows a view of a ground tiller according to an embodiment of the present invention. In FIG. 55, the rotating drum is replaced with rotating tines 181, which may well be mounted on a drum of some sort. Other embodiments related to this include stump grinder, rotary broom or sweeper, or wheel saw.

Figure 56:
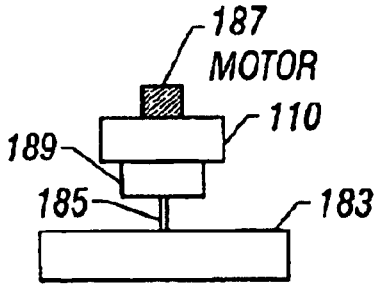
FIG. 56 shows a view of a tub grinder according to an embodiment of the present invention.

In another embodiment, FIG. 56 shows a view of a tub grinder according to an embodiment of the present invention. In this embodiment, tub grinder 183 is rotatably coupled to shaft 185 which is in turn coupled to ratchet 189. The vibratory box 110, thru motor 187, drives this ratchet 189.

Figure 30:
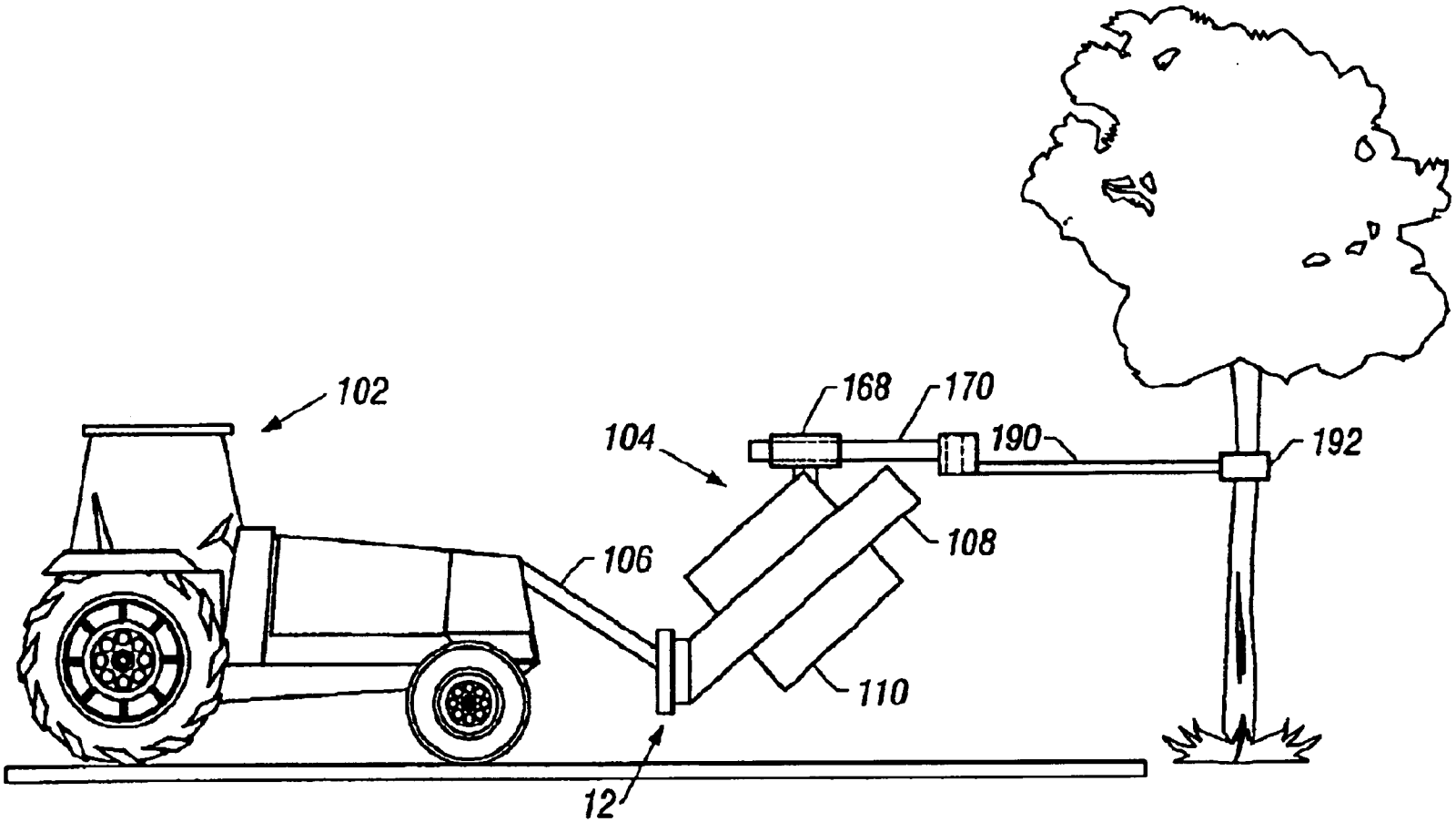
FIG. 30 shows an embodiment of the present invention in which the same is implemented with a tree shaker.

In another embodiment, as shown in FIG. 30, the device may be used as a nut tree shaker. In the nut tree field, there is a need for a device that may be employed to shake the nuts off of a nut tree. The same is true for various fruit trees and berry trees.

Figure 31:
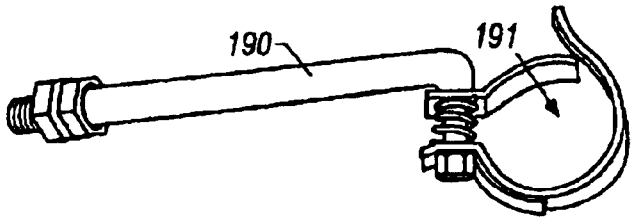
FIG. 31 shows a tree shaker which may be implemented with an embodiment of the present invention.

The device may be outfitted with an arm 190 that may be screwed into the extension tool 170 on a proximal end and may be attached to the trunk of a nut tree on a distal end via a grip 192 that is of a wrap-around type. By causing the device to vibrate in the manner described above, the nuts on the nut tree may be effectively shaken off. The arm may further contain an overriding spring 191 that compresses to prevent damage to the vibratory device or to the tree (see FIG. 31).

It will be clear to one of skill in the art that the placement of arm 170 will affect the direction of vibratory motion. For example, in the case of FIG. 30, it would be desired, given the application, to provide a shaking force in a direction parallel to the ground. Thus, arm 170 may be attached at the top of the vibratory box 110 as shown. The same may also be placed at the bottom, i.e., across the diagonal from that shown. Other placements may be used as the circumstance dictates. In fact, in almost all of the drawings, the arm may be placed at various other points on the vibratory box 110 to effect a different type of motion. For this reason, a plurality of sockets may be used in various locations on the vibratory box 110 to allow such connections.

Figure 32:
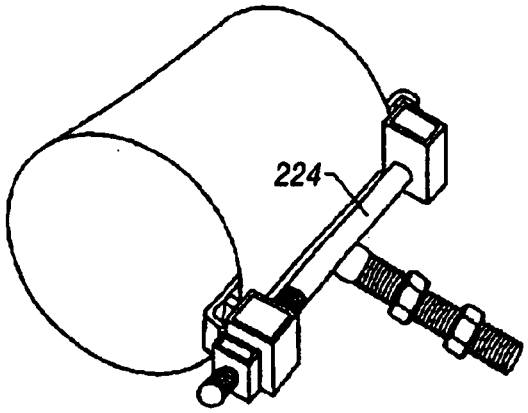
FIG. 32 shows a drum shaker which may be implemented with an embodiment of the present invention.

It will be clear to one of skill in the art that by replacing arm 170 with an arm having a larger grip, the device may be made into a barrel shaker. In this case, the larger grip would attach to a barrel either around the circumference thereof or to the top and bottom ends. Of course, this embodiment may be used not only for barrels but also for drums, cans, e.g., paint, etc. FIG. 32 shows an example of a barrel or drum shaker 224 that grips a barrel by the top and bottom ends.

Other items which may be so shaken including hoppers, tanks, vehicles, etc.

Figure 33:
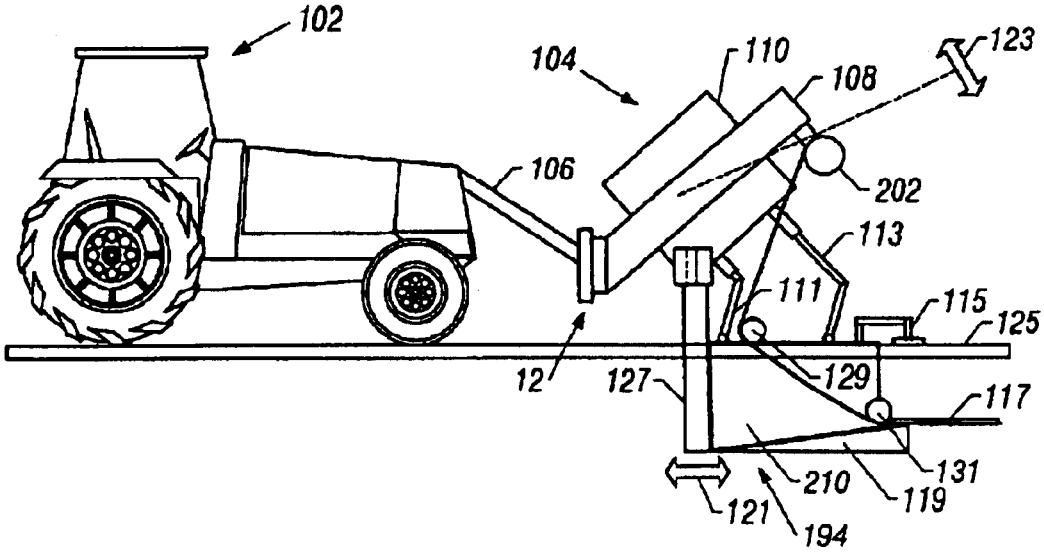
FIG. 33 shows an embodiment of the present invention in which the same is implemented with a cable-laying device.
Figure 34:
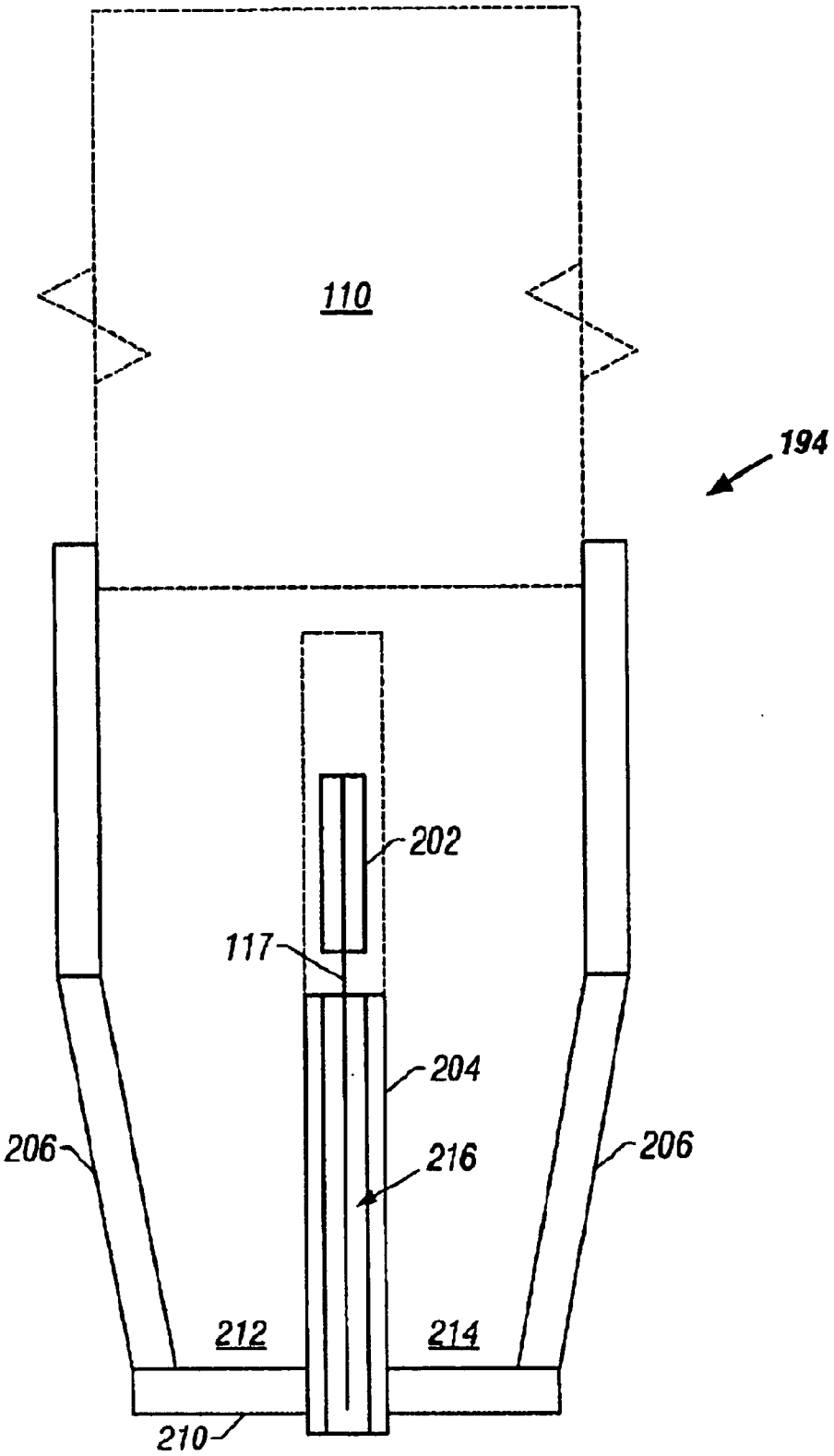
FIG. 34 shows an end-on view of the cable-laying device of FIG. 33.
Figure 35:
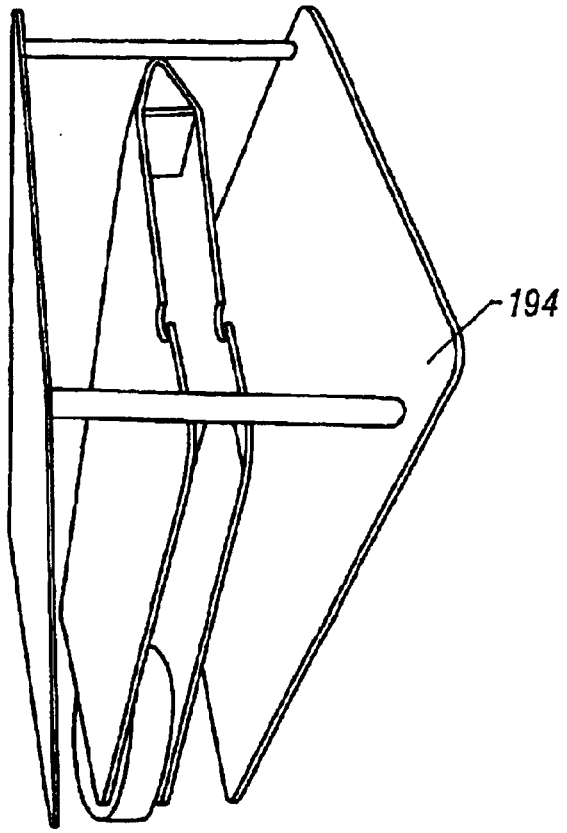
FIG. 35 shows a cable-laying device which may be implemented with an embodiment of the present invention.

In another embodiment, as shown in FIGS. 33, 34, and 35, a cable-laying device may incorporate the present invention. It should be noted that FIG. 35 is looking at the device from the rear. The central blade may be seen pointing away from the viewer.

Referring in particular to FIG. 34, the cable-laying device 194 has a bottom cutting and guiding piece 210 and two side cutting and guiding pieces 206. A center cutting piece 204 is also employed for splitting the soil. A front blade, such as a trencher blade 127, may be used to cut the soil into a trench shape.

The cable-laying device 194 may be guided into a section of ground 125 in which cable is to be laid. The guiding of the device 194 is assisted by vibration of the vibratory device 104 and the blade 127.

Figure 36:
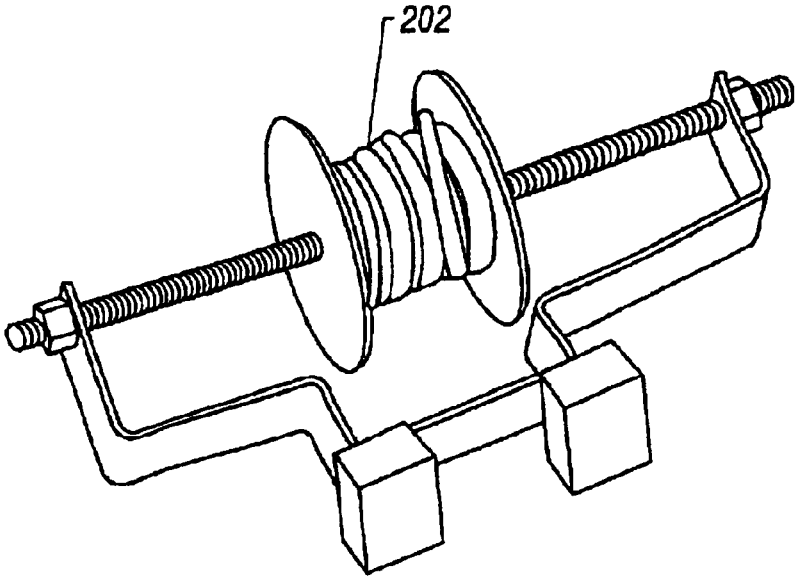
FIG. 36 shows a cable-spool attachment which may be implemented with, e.g., the embodiment of the present invention as shown in FIG. 33.

The tractor 102 may then be driven backwards (in the figure shown), guiding displaced earth into inclined channels 212 and 214 as the same is cut by blade 127. This also serves to clear a small path between the two channels 212 and 214. In the center of the small path between the two channels 212 and 214 a hollow 216 is provided in which a cable 117 may be disposed as fed off a spool 202 (see also FIGS. 33 and 36).

In operation, the backward motion of the tractor 102, coupled with the vibration of device 104, feeds earth into channels 212 and 214 and away from the hollow 216. The cable 117 is fed down the hollow 216 from the spool 202 and is so laid between the two channels 212 and 214. As the tractor moves backward, the earth is passed through the channels and back into the trench dug by the blade 127 and the bottom and side cutting and guiding pieces 210 and 206. Tamping may then be employed, if desired, via oscillation of element 194, using an optional tamper 115. The general approximate motion of the vibratory box housing 110 is shown in FIG. 33 by double-headed arrow 123, and the general approximate motion of the cutting blade 127 is shown in FIG. 33 by double-headed arrow 121.

Referring again to FIG. 33, it is seen that an open area 119 may remain after cutting, and a cable 117 may be laid on top of the open area. Two rigid arms 111 and 113 may be employed to assist and to a certain extent direct the motion of the vibratory device 104 to the various cutting surfaces. An upper guide pulley 129 and a lower guide pulley 131 may be employed to guide the cable to the proper location in the trench.

It is important to note that the connections of the blade and of the guiding pieces to the vibratory device 104 allow essentially different motions to be performed by each. For example, the blade 127 cuts the soil by being vibrated back and forth in essentially a direction parallel to the ground and perpendicular to the blade edge. On the other hand, the guiding pieces, coupled to the rigid arms, allow a vibratory conveyor effect: the same are lifted up with one vibratory motion direction and, as the tractor moves, the guiding pieces are moved with very little friction to a new location, thus essentially moving the soil carried by the guiding pieces to a new location within the guiding pieces. In other words, the soil is conveyed along the guiding pieces and eventually may exit the guiding pieces or be transported to another location as required.

It is estimated that cable laid in this fashion may be laid at highly enhanced rates compared to conventional techniques. Depending on depth and soil conditions, footage covered may increase 30–50% and in some cases by 200–300%.

Figure 38:
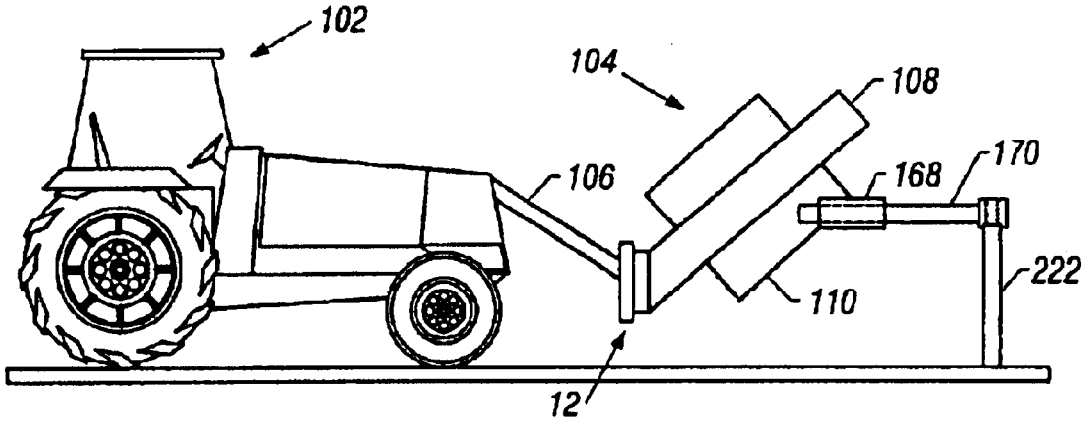
FIG. 38 shows an embodiment of the present invention in which the same is implemented with scarifier blades.
Figure 39:
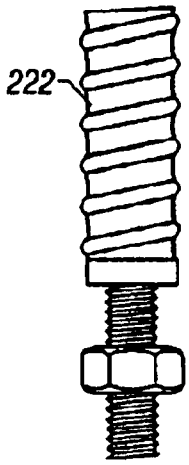
FIG. 39 shows a scarifier blade which may be implemented with an embodiment of the present invention.

Referring to FIG. 38, a set of scarifier blades 222 may be attached to the extension tool 170. Scarifier blades 222 are especially useful in asphalt cutting and are shaped in a wavy fashion and sharpened on both sides. They may be mounted to the vibratory device directly (not shown) or through the extension tool. Such blades can cut in both directions of travel. The wavy design, which is shown best by FIG. 39, when going through an arc due to the pendulum motion, will raise the asphalt slightly and break up the same, making for an easy removal.

Figure 43:
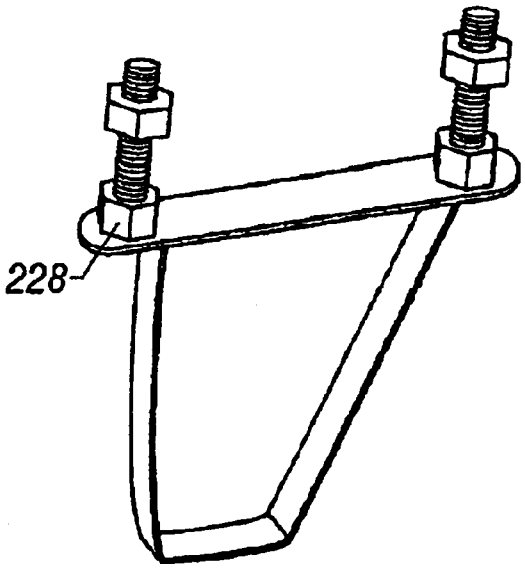
FIG. 43 shows a trencher blade which may be implemented with an embodiment of the present invention.

Referring to FIG. 43, a trencher 228 is shown which may be advantageously employed in combination with the present invention. In particular, the same may be attached to the extension tool 170 and placed in a hole to dig a trench. For example, once placed in the hole, the trencher 228 may be vibrated with the vibratory device 104 in order to provide a cutting action. The vehicle attached to the vibratory device, such as a tractor, may then be moved in the desired trench direction in order to cut the same. If it is not desired to dig a hole in which to place the trencher, the trencher may be attached to a ratchet device (see below) and forced into a section of ground in the same manner as the tree stump remover described below.

It is also noted that the trencher may be the same as the blade 127 in the cable layer of FIGS. 33–36. However, in the trencher, portions of the cable layer device are removed as can be seen in FIG. 43. The incline and length of the trencher may be increased relative to the cable layer as well in order to, e.g., transfer soil to a surface conveyor (which as is noted herein can be additionally powered by the vibratory device). It will be clear to one of skill in the art that this facility may be used to create a windrow, for example.

Further, depending on the details of the trencher, the same may be used to create an open trench or a closed trench, as dictated by the needs of the user. The trencher may further incorporate other tools, such as a vertical blade, etc.

Figure 44:
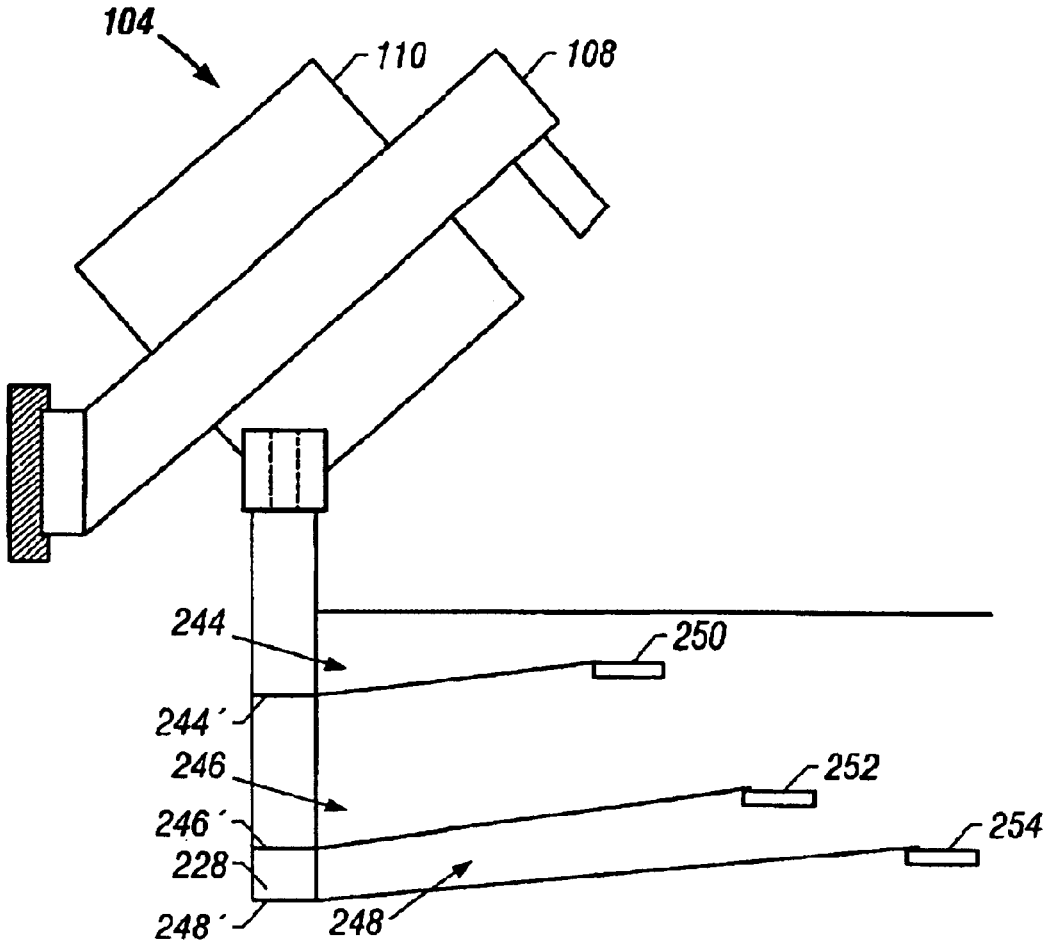
FIG. 44 shows an embodiment, related to the trencher blade, in which soil separation may be achieved, as may be implemented with the present invention.

A variation of the trencher is shown in FIG. 44. This embodiment may be used for separation of materials. As shown, three cuts 244, 246, and 248 may be made by blade 228 and in particular blades 244', 246', and 248'. Such a device may be useful in, e.g., placer mining, where gold samples would generally sink to the bottom. The same may also be useful in sampling various layers of soil. In this embodiment, optional cross-conveyors 250, 252, and 254 may be used to carry material away from each of these cuts, respectively, i.e., in a windrow fashion. The cross-conveyors, or any other conveyors, can be driven off the vibratory box in the fashion elsewhere described. In any case, the conveyors are supported by braces attached to the tractor or other such frame and are generally adjustable. A vibrating conveyor may be employed and substituted for the belt conveyor if desired by using the vibration of the device 104 as communicated via a linkage.

Figure 46:
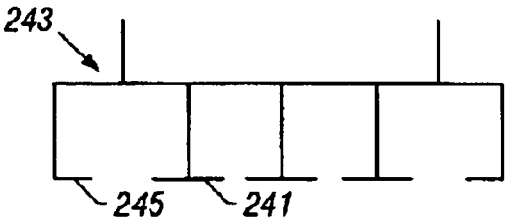
FIG. 46 shows a front view of a blade which may be employed with an embodiment of the present invention.

FIG. 46 shows a front view of a blade which may be employed to cut asphalt. Blade 243 has "L"-shaped sections 245 and "T"-shaped sections 241. As the blade 243 penetrates asphalt or other such material, on the forward portion of the oscillation, the sections 241 lifts part of the asphalt as the vertical portions cut into the same. The back of the sections 241 are bent upward which elevates all the asphalt material to the conveyor. The blade cuts at the depth of the asphalt, leaving soil in place. This method allows for asphalt reclaiming which is desired for saving energy and resources. Alternatively, the blade may cut only part way down on the asphalt, leaving room for a fresh new layer of asphalt to be laid over the old. The old asphalt of course may be rolled and tamped prior to being covered with the new.

Figure 45:
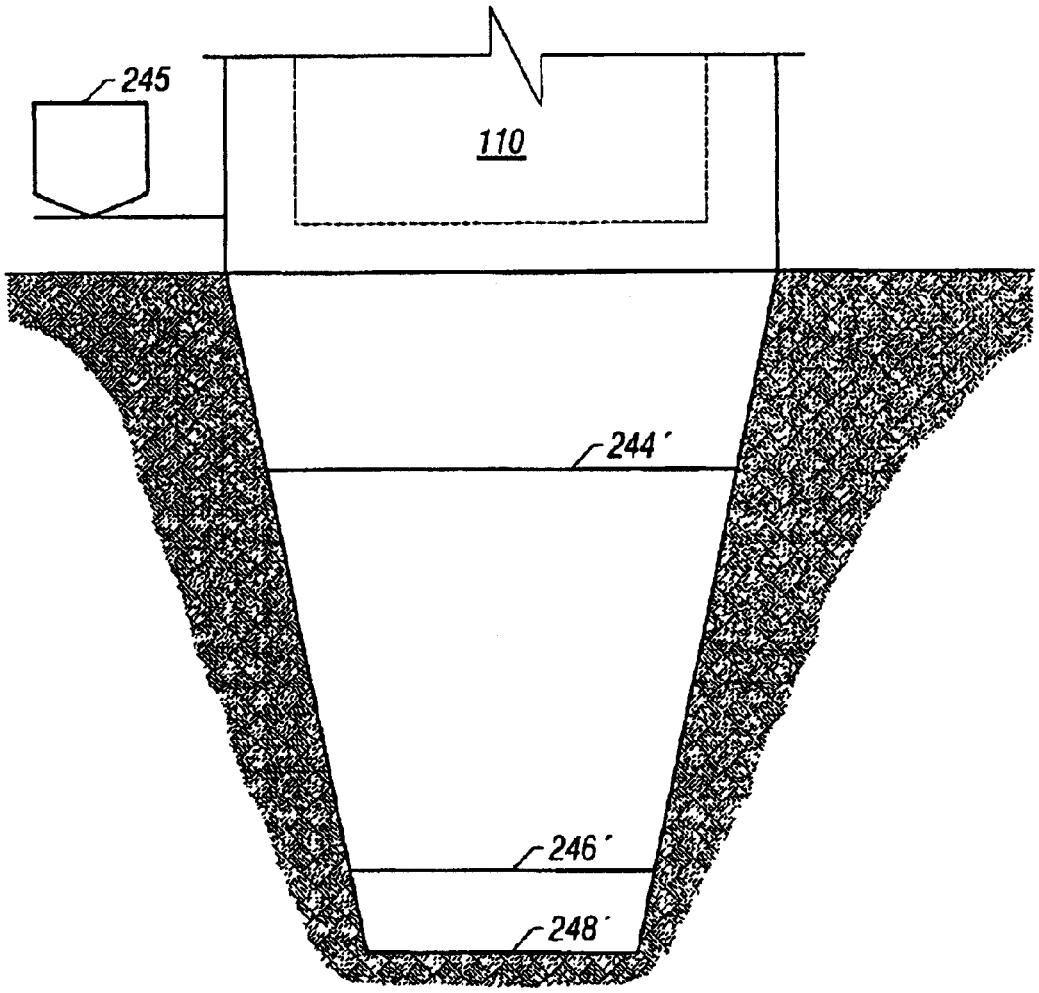
FIG. 45 shows another view of the embodiment of FIG. 44.

In another embodiment, shown in FIG. 45, a liquid or gas container 245 may be mounted adjacent the blade 228 for agricultural use, e.g., to introduce fertilizers at the root level underground. In addition, the same may prevent run-off and provide the overall device with enhanced efficiency.

In another embodiment, that of an open trencher, a similar system may be employed. In this system, however, the center portion of the cable layer may be removed and the incline of the device may be increased and lengthened, in a similar manner as above, to transfer the soil to another conveyor.

Figure 47:
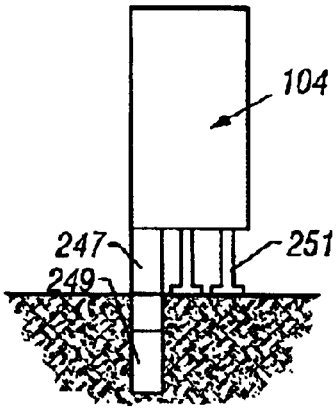
FIGS. 47 and 48 show view of a concrete cutter which may be implemented with an embodiment of the present invention.
Figure 48:
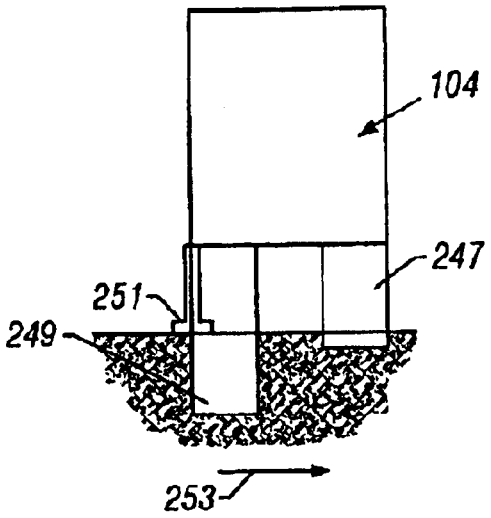

When cutting concrete, as shown in FIGS. 47 and 48, a first blade 247 scores the concrete by cutting approximately 1–2" deep a slot which is immediately followed by another same thickness blade 249 while simultaneously pads 251 strike the concrete with a downward motion. The combination of the weakening of the concrete by blade 247 and the wedging and shock effect of blade 249 that is longer than the thickness of the concrete causes the concrete to break along the scored line when struck by the pads.

Extensions of this embodiment may also be seen. By adding multiple blades and staggering them one behind the other across the face of the concrete cutter, and adding means to maintain a specific cutting depth, the blades would last an exceptionally long time, especially as compared to current cutters.

Figure 49:
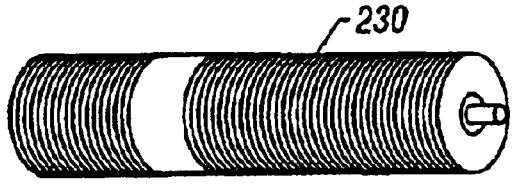
FIG. 49 shows a grid layer spool that may be implemented with an embodiment of the present invention.

Referring to FIG. 49, a grid layer spool 230 is shown. Grid layer spool 230 may operate in a similar fashion to the vibrating roller described above, except for being placed slightly above the surface. However, grid layer spool 230 may lay down a grid for, e.g., asphalt reinforcement and barrier control.

Figure 64:
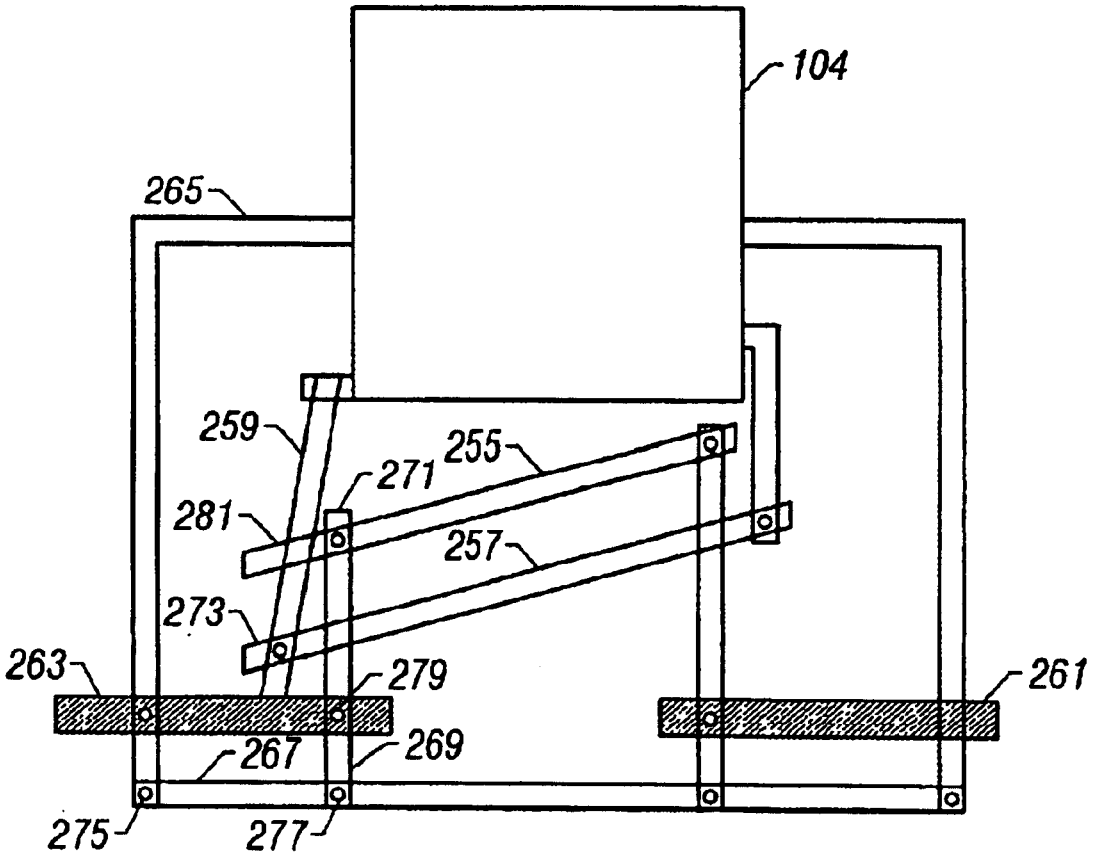
FIG. 64 shows a shaker screen according to an embodiment of the present invention.

Referring to FIG. 64, a vibrating sloped "rock" or screen 2-deck system is shown. In this system, the vibratory device 104 oscillates, oscillating arms 261 and 265 in turn. Both these arms and linkages 267, 269, and 271 are pivoted at points 273, 275, 277, 279, 281, and 283. Both ends and sides of the linkage are the same. Braces 263 and 261 mount to the tractor or frame. When the vibratory device oscillates one way, it moves the deck 255 in a direction opposite to that in which it moves the deck 257, canceling out most undesirable vibrations. Most standard rock screens use a separate shaft and off-weighted flywheel or other mechanism to accomplish the vibration condition. As the two screens follow the motion of the vibratory device 104, the same raises and lowers the decks slightly, making the material on the screen advantageously slightly airborne.

Tools Employing Ratchets

Figure 28:
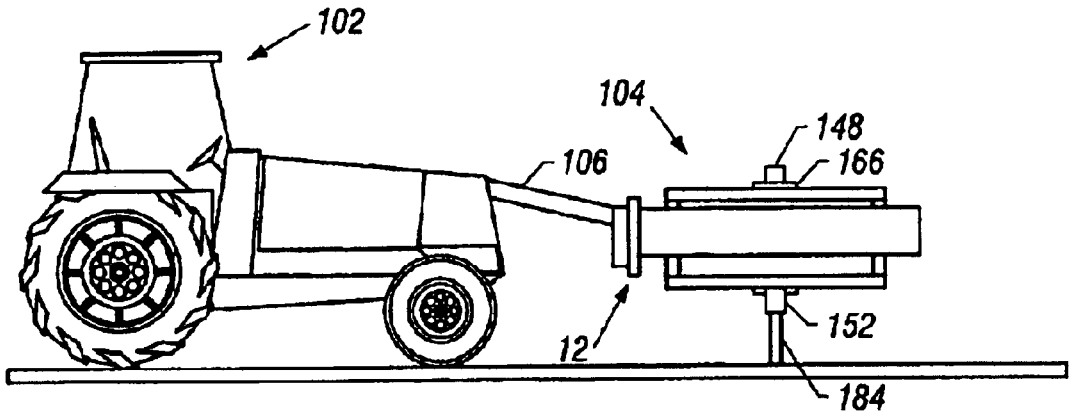
FIG. 28 shows an embodiment of the present invention in which the same is implemented with an auger drill.
Figure 29:
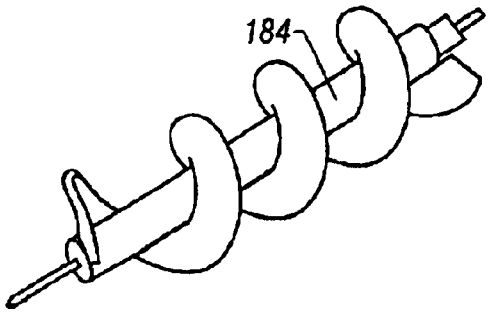
FIG. 29 shows an auger which may be implemented with an embodiment of the present invention.

Referring to FIG. 28, by placing the drive shaft distal end 152 perpendicular to the ground via a swivel as described above and employing the ratchet 166, a vertical boring operation may be performed employing bore 184 (see also FIG. 29, which shows an auger drill, although operation of a vertical or horizontal bore would be analogous). As noted above with respect to ratchet operations, it is not strictly necessary that the axle of the motor be collinear with the axle of the bore. The same may be offset by way of a gear or a belt.

It should be noted that in such embodiments the auger may be fitted with a universal coupling so that the auger may be in plumb if desired.

A horizontal bore may be driven directly from the distal end of the drive shaft 152 so long as the drive shaft is parallel to the ground, such as is shown in FIGS. 1–4, 6, and 20. However, in these figures, the power of the tractor may have difficulty in pushing the bore forward since the bore is rotating at right angles to the direction of movement of the tractor. In this case, it is preferable to use the swivel of FIG. 7 to rotate the drive shaft distal end 152 such that the same is parallel to both the ground and the direction of movement of the tractor.

Both vertical and horizontal boring tools may employ a quick-coupling at the drive shaft or elsewhere to affix the vibratory device after location of the plumb position or a point relative thereto. The ratchet device may also be used to perform or help perform the rotation.

In this same configuration, the device may be employed as a commercial pipe cleaner. However, in this embodiment, the horizontal bore is replaced with a commercially available pipe cleaner, i.e., a large cylindrical brush. By moving the tractor in a forward and backward direction, cleaning of a commercial pipe may be accomplished in a longitudinal direction. By the rotational motion of the ratchet, the commercial pipe cleaner may be caused to rotate and clean a pipe in an azimuthal direction. Of course, it will be clear to one of ordinary skill in the pipe cleaning art that this system may also be employed in the absence of a ratchet. That is, the back and forth motion of the tractor, coupled with the vibration, may be enough to clean the pipe per se.

Figure 37:
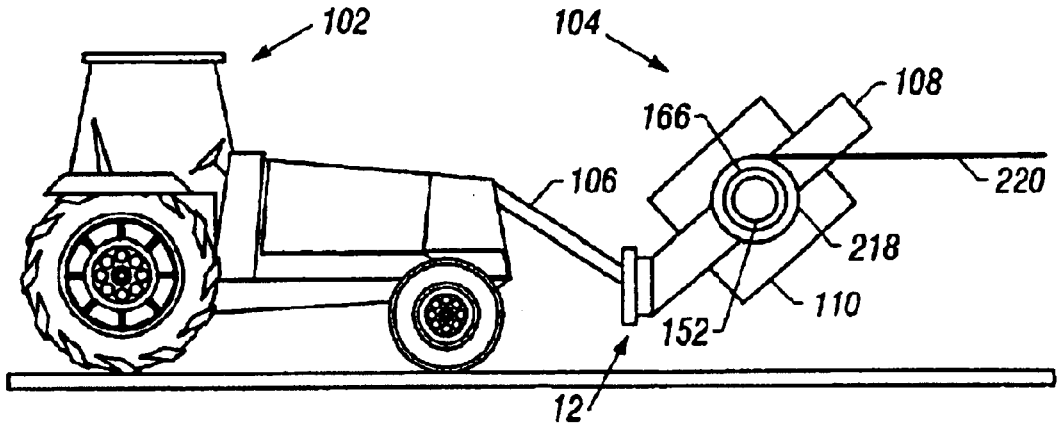
FIG. 37 shows an embodiment of the present invention in which the same is implemented with a winch.

Referring to FIG. 37, an embodiment of the invention showing a winch is illustrated. Drive shaft 152, driving ratchet 166, is shown directly connected to winch 218 having a rope 220. The winch 218 may be rotated using the motion of the vibratory device 104 in combination with the ratchet 166 as described above. The winch may be a standard pulley and may be made for easy mounting. The same may be wound in either direction, and may preferably be designed to not "free wheel". It will be clear to one of skill in the art, given the teaching of this specification, that various other wheeled devices may be operated similarly, including a conveyor, etc.

Figure 40:
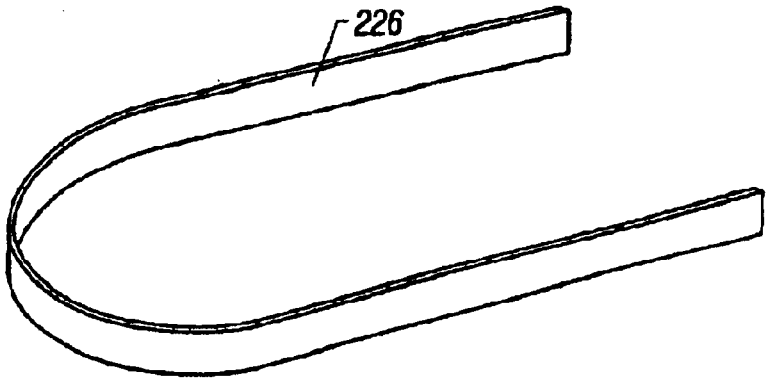
FIG. 40 shows a stump removal blade, in combination with a vibratory box, which may be implemented with an embodiment of the present invention.

Referring to FIG. 40, a blade 226 which may be used for stump removal in combination with an embodiment of the invention is illustrated. A blade 226 is shown which may be mounted such that each connection point 228 is on an opposite side of the vibratory device 104. By having each connection point 228 connect to the ratchet 166, a powerful rotation force can be established. By placing the blade 226 such that the same essentially surrounds the tree stump, for example, and operating the vibratory device 104 with ratchet 166, the blade 226 can be made to enter a spot of ground and cut underneath a tree stump. Of course, other uses may also be envisioned besides tree stump removal.

Figure 41:
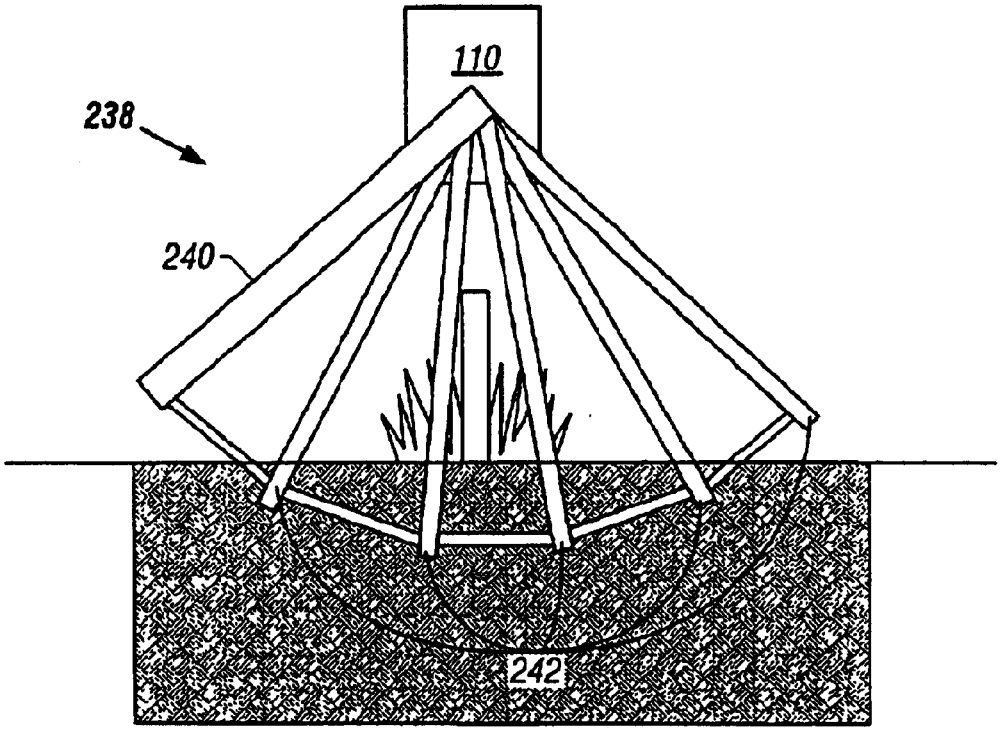
FIG. 41 shows an embodiment of a stump removal blade which may be implemented with an embodiment of the present invention.
Figure 42:
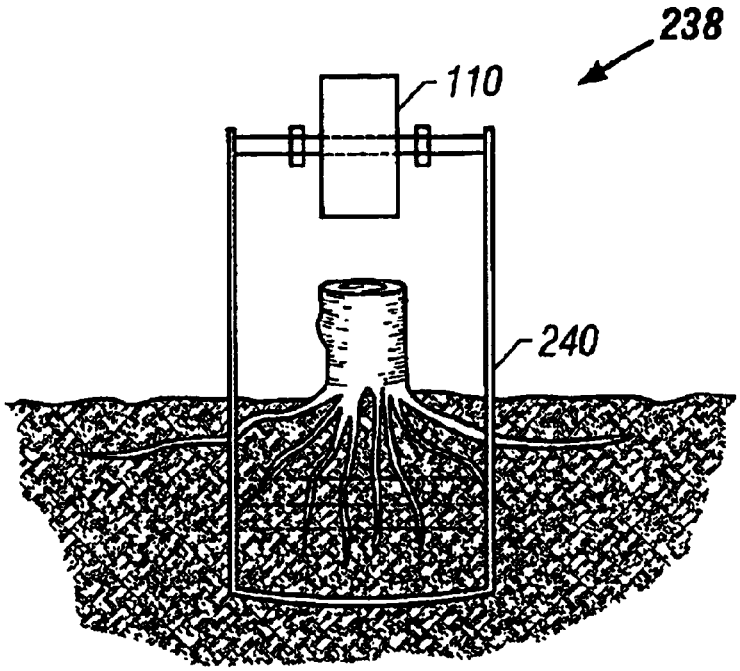
FIG. 42 shows another view of a stump removal device incorporating an embodiment of the present invention.

An enhanced version of this embodiment is seen in FIG. 41. In FIG. 41, a stump remover 238 is shown. Stump remover 238 includes a main cutter blade 240 and a series of, e.g., five, fan blades 242. The main cutter blade 240 acts as above. The fan blades 242 may follow the main cutter blade and act as a net to hold the stump and roots in place. The tractor boom, by raising the vibratory device 104, may also then raise the stump and the roots from the ground. In either case, the stump remover may rigidly mount to the ratchet and the main shaft. Another view of the stump removers is shown in FIG. 42.

The main blade may be made of, e.g., alloy metals in the 300,000 psi class. The same may also be thin, e.g., approximately ⅜" and sharpened on one side and of a length and width sufficient to cut roots on the side and bottom end of the stump and below the stump as the cutter vibrates through the cut. The ratchet assembly may contain a regular pulley or a cog pulley in order to drive the second shaft by continuous RPM or by intermittent ratcheting RPM.

Figure 50:
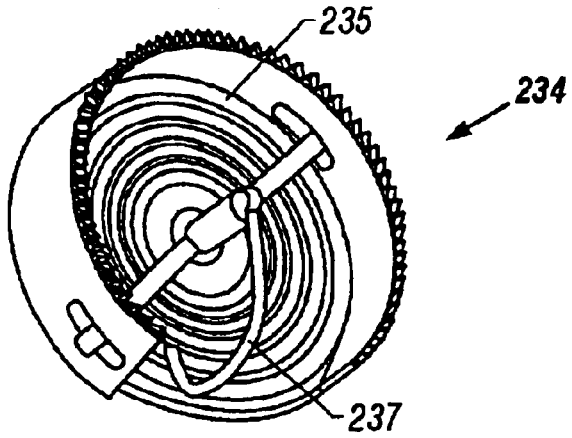
FIG. 50 shows an asphalt circle cutter that may be implemented with an embodiment of the present invention.

Referring to FIG. 50, an asphalt circle cutter 234 is shown. Asphalt circle cutter 234 may employ a cutting blade 235 as well as a shield 237 for deflecting cut asphalt away from the cutter 234. The operation of asphalt circle cutter 234 may be that the same is disposed on the ratchet 166 where the shaft of ratchet 166 is vertically mounted. By placing the cutter 234 over the area to be cut, and lowering the cutter 234 to the asphalt, a well-defined circle may be cut and the asphalt removed. In another embodiment, the asphalt circle cutter may be used without the ratchet 166.

Figure 57:
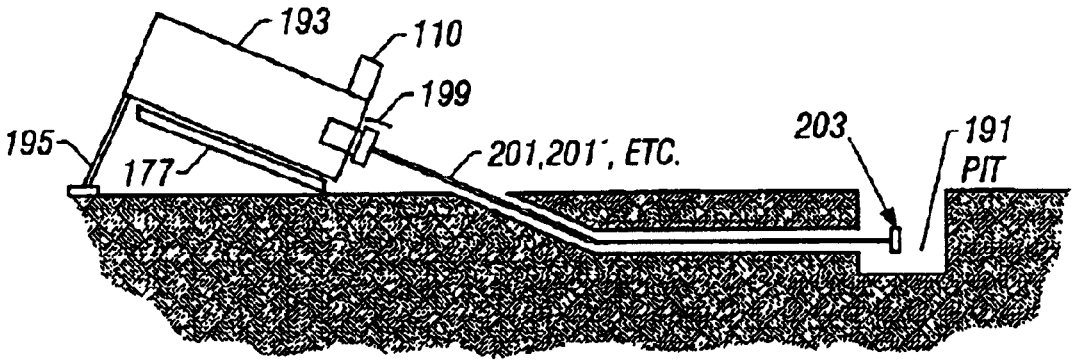
FIGS. 57 to 59 show views of a horizontal driller according to an embodiment of the present invention.
Figure 58:
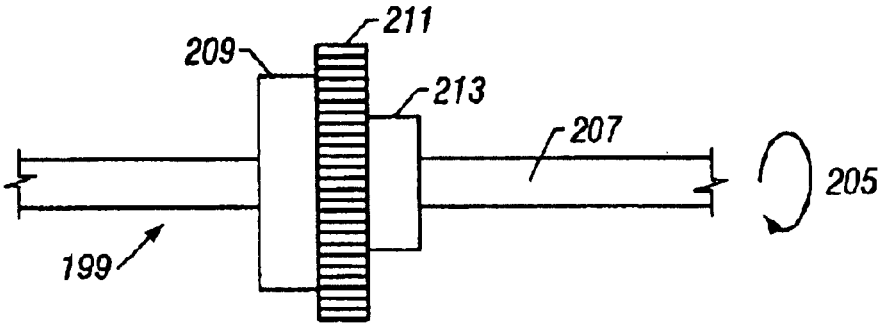
Figure 59:
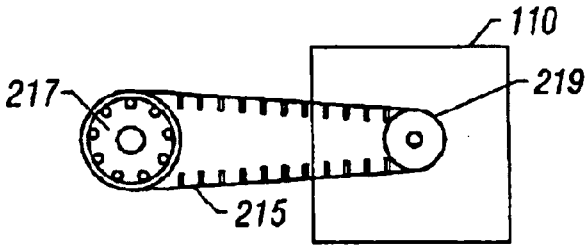

Referring to FIGS. 57 to 59, horizontal below-ground drilling equipment may also benefit from an embodiment of the present invention, in which drilling speeds may be enhanced, especially when drilling through rock or other hard materials without cutting an open trench. Typical drilling machines 193 rotate a bit and drilling rod 201, 201', etc., underground and add, e.g., 10' sections of rod as they proceed inward with a small pilot hole. As the end of the rods, e.g., at about 100', a larger bit 203 is installed while the distal end of the rods are within a pit 191. The larger bit cuts a hole upon its return, pulling cable or the like through the tunnel and completing the boring. Note that the vibratory box, in winch mode, could assist in the cable-pulling. One of the major difficulties associated with such systems is the sticking of the bit on rock, particularly when the drilling system is employed beyond its intended functionality.

The vibratory box 110 rotates a spindle assembly 199 via its ratchet and pulley (not shown) and a belt. The rotating portion of the spindle 213 is driven by this belt via pulley 211. As the vibratory box oscillates, it transfers the movement to the ratchet which aids the drilling by creating, e.g., several thousand short impulses of high torque in the same rotational direction as the drilling rod. These impulses cause the bit to cut in a more high-speed fashion.

Figure 60:
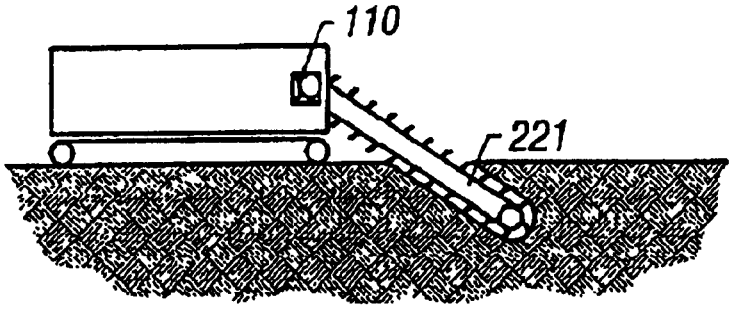
FIG. 60 shows a view of a trench driller according to an embodiment of the present invention.

FIG. 60 shows a related embodiment, in which the vibratory device 104 is attached to a trench driller. The device 104 can increase the production of the typical carbide-tipped or regular trencher, and can mount relative to the trenching assembly 221 in a position approximately such as that shown in FIG. 60.

Figure 61:
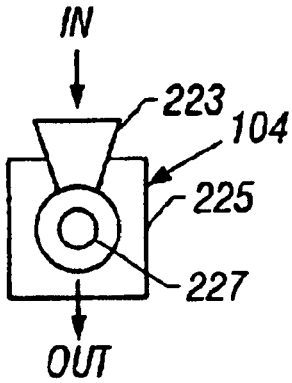
FIGS. 61 and 62 show views of a trommel device according to an embodiment of the present invention.
Figure 62:
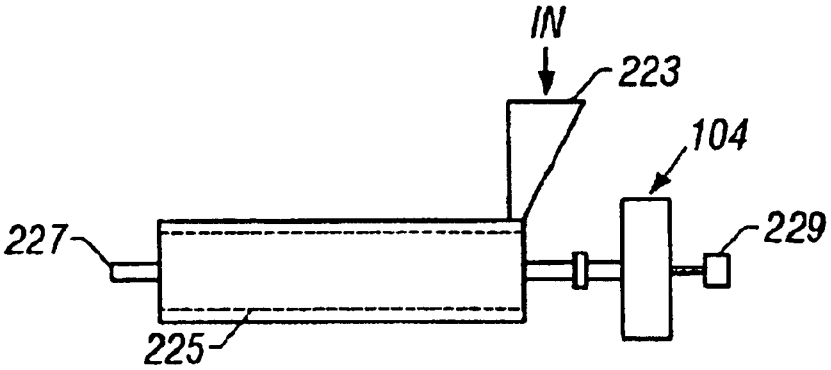

FIG. 61 shows an embodiment in which the vibratory device 104 is attached to a trommel device 225. Trommel 225 has an input 223 and an output 227. A motor 229 drives the vibratory device 104.

The trommel is supported by an end bearing and generally stands near an outlet that stands on a ground surface. The trommel attaches to a flexible coupling on the device's main shaft.

Variations of this embodiment are manifold. For example, a concrete mixer can substitute for the trammel. A sludge dewatering device can be used by rotating a properly designed spiral and driving the same with a ratchet. This gains high torque values, and compresses the sludge.

It will be understood that the above description of a "Method and Apparatus for Vibratory Kinetic Energy Generation and Applications Thereof" has been with respect to particular embodiments of the invention. While this description is fully capable of attaining the objects of the invention, it is understood that the same is merely representative of the broad scope of the invention envisioned, and that numerous variations of the above embodiments may be known or may become known or are obvious or may become obvious to one of ordinary skill in the art, and these variations are fully within the broad scope of the invention.

Figure 63:
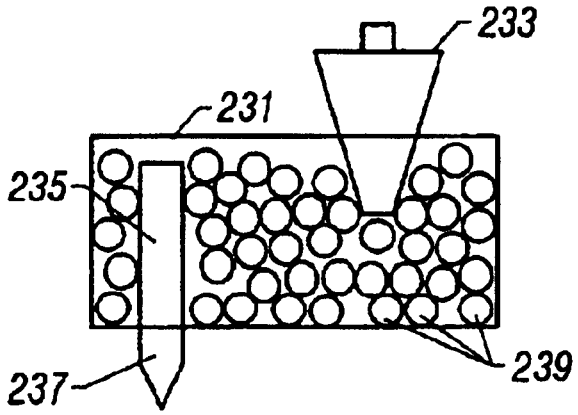
FIG. 63 shows a view of a wedge device according to an embodiment of the present invention that may be employed to attach the attachment tool to the vibratory device.

For example, the vibratory box 110 may take on a number of different constructions and arrangements. The term "tractor" as used herein is to mean not only the common definition but also indeed any vehicle capable of carrying the vibratory device. Also, when used in a roller embodiment, the device may employ a "sheeps foot" or alternatively a roller pad with extensions for tamping trenches may be used. When the device is used as a scraper, tile, asphalt, or ceramic may be removed. Smaller models may remove building tile, tar paper, or other coverings. A long single blade (not shown), e.g., bent at an angle outward, may be used to cut roots of bushes and small trees by circling the bush. While cutting at depth, this embodiment will serve to cut all the roots. To anchor the various to the device 104, a driven wedge 233 can be used to "jam" steel balls 239 in a friction fit into the attachment tool 235 that is otherwise contained in a steel box 231 or the like (see FIG. 63). To release the wedge, a counteracting oscillation can be applied. Reduction of rebound in, e.g., impact tools such as destruction tools may be accomplished by provision within the vibratory device 104 of a box partially filled with "shot" or other heavy but movable materials. As the device 104 accelerates towards a maximum point, the shot will gather on the side of the box opposite the maximum point. As the device 104 strikes a "target" at the maximum point, and begins to rebound, the shot will continue to move in the original direction, driving the device 104 back into the target or at least reducing the force of the rebound, enhancing the destructive energy passed to the target. A weight that was pivotally mounted or coupled via a spring to the box within device 104 would accomplish a similar result.

The main drive shaft can rotate at speeds less than that driving the off-weights, so as to create a faster rpm to drive the ratchet that creates an impact shock on the drive tool shaft that is driven by the rpm of the main shaft. This momentarily creates a speed-up of the drill or drive shaft at the rate of the amplitude created by the off-weight rpms. When the vibratory device is driven by the correct hydraulic motor, the slight momentary increase in a partial rmp is relieved inherently in the hydraulic system. If the shaft is driven by a mechanical coupling and gas engine, provisions may be made to allow a temporary and brief speed-up of the shaft coupling. This can be accomplished by a rubber tire-like coupling or torque release device. If a second shaft is used to drive tools, two belts should be used—one to rotate the second shaft at a constant speed that is lower than the ratchet speed. Ideally, timing belts could be used.

Accordingly, the scope of the invention is to be limited only by the claims appended hereto, and equivalents thereof. In these claims, a reference to an element in the singular is not intended to mean "one and only one" unless explicitly stated. Rather, the same is intended to mean "one or more". All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present invention is intended to be dedicated to the public regardless of whether the element, component, or method step is explicitly recited in the claims. No claim element herein is to be construed under the provisions of 35 U.S.C. §112, ¶6, unless the element is expressly recited using the phrase "means for".

What is claimed is:

1. A device for performing a task employing vibration of a tool, comprising:

A housing containing at least one off-center weight, the off-center weight coupled to a motor and configured to rotate or revolve to vibrate the housing, the housing further including a device mount to allow the housing to be removably coupled to a mount on a vehicle;

A tool, removably coupled to the housing via a socket on the housing, to perform a task; and A means for providing at least one of off-center weight control or precession relief, Such that the housing may be coupled to a plurality of types of vehicles and such that a plurality of types of tools may be coupled to the housing.

2. The device of claim 1, wherein the tool is selected from the group consisting of: bores, augers, cable layers, trenchers, blades, shakers, rollers, planars, grinders, tillers, rakes, tampers, grid layers, scarifiers, conveyors, winches, scrapers, mixers, shaker screens, corers, destruction tools, drills, cutters, double line cutters, pipe cleaners, and combinations thereof.

3. The device of claim 2, wherein the task is a cutting task, and the tool is a cutting tool, and wherein the cutting tool has a substantially "U"-shaped blade projecting from the socket coupling, such that vibration of the "U"-shaped blade cuts desired material, and material so cut falls at least partially within the "U"-shaped blade.

4. The device of claim 3, further comprising a cable-laying system, whereby cable laying end trench digging are preformed simultaneously.

5. The device of claim 3, further comprising a soil-separating system, whereby soil separating and trench digging are performed simultaneously.

6. The device of claim 1, wherein the tool is a cutting tool and is selected from the group consisting of: an asphalt cutter, a blade, and a trencher.

7. The device of claim 1, further comprising:

A gimbel on which the housing is at least partially mounted, the gimbel structured and configured such that the housing may rotate from one orientation to another on the gimbel; and A ratchet having an axle about which the ratchet may rotate, the ratchet rotatably coupled to the housing, such that vibration of the housing causes rotation of the axle.

8. The device of claim 7, wherein the tool is selected from the group consisting of a drill, an auger, a winch, a stump remover, and an asphalt circle cutter.

9. The device of claim 1, further comprising a removable leaf-spring system, including:

A leaf spring coupled to the housing; and

At least two points between which the leaf spring may oscillate.

10. A method for performing a task employing vibration of a tool, comprising:

Providing a housing containing at least one off-center weight, the off-center weight coupled to a motor and configured to rotate or revolve to vibrate the housing, Removably mounting the housing via a device mount to a mount on a vehicle;

Removably mounting a tool to the housing via a socket on the housing, to perform a task;

Rotating or revolving the off-center weight; and

Providing precession relief for the off-center weight.

11. The method of claim 10, wherein the tool is selected from the group consisting of: bores, augers, cable layers, trenchers, blades, shakers, rollers, planars, grinders, tillers, rakes, tampers, grid layers, scarifiers, conveyors, winches, scrapers, mixers, shaker screens, corers, destruction tools, drills, cutters, double line cutters, pipe cleaners, and combinations thereof.

12. The method of claim 10, wherein the task is a cutting task, further comprising removably mounting a "U"-shaped cutting tool to the housing via a socket on the housing, to perform the cutting task, the cutting tool having a substantially "U"-shaped blade projecting from the socket coupling, such that vibration of the "U"-shaped blade cuts desired material, and material so cut falls at least partially within the "U"-shaped blade.

13. The method of claim 10, further comprising:

Providing a ratchet having an axle about which the ratchet may rotate, the ratchet rotatably coupled to the housing, such that vibration of the housing causes rotation of the axle;

mounting the tool to the ratchet, to perform a task.

* * * * *